US007939032B2

(12) United States Patent
Hanafusa et al.

(10) Patent No.: US 7,939,032 B2
(45) Date of Patent: May 10, 2011

(54) MICROCHIP PROCESSING APPARATUS

(75) Inventors: Nobuhiro Hanafusa, Kyoto (JP); Katsuhiko Seki, Kyoto (JP); Taigo Nishida, Kyoto (JP); Tomokazu Sudo, Kyoto (JP); Katsuya Kashiwagi, Kyoto (JP)

(73) Assignee: Shimadzu Corporation, Kyoto-Shi, Kyoto (JP)

( * ) Notice: Subject to any disclaimer, the term of this patent is extended or adjusted under 35 U.S.C. 154(b) by 1067 days.

(21) Appl. No.: 11/529,335

(22) Filed: Sep. 29, 2006

(65) Prior Publication Data

US 2007/0104615 A1 May 10, 2007

(30) Foreign Application Priority Data

Oct. 11, 2005 (JP) ..... 2005-296538

(51) Int. Cl.
*B01L 3/00* (2006.01)

(52) U.S. Cl. ..... 422/500; 422/501; 422/560; 422/561; 422/562; 436/180; 73/864.01; 73/864.11

(58) Field of Classification Search ..... 422/99–101, 422/500–501, 560–562; 436/180; 73/864.01, 73/864.11

See application file for complete search history.

(56) References Cited

U.S. PATENT DOCUMENTS

| | | | | | |
|---|---|---|---|---|---|
| 5,270,210 | A * | 12/1993 | Weyrauch et al. | ..... | 436/43 |
| 5,384,261 | A * | 1/1995 | Winkler et al. | ..... | 506/18 |
| 5,582,796 | A * | 12/1996 | Carey et al. | ..... | 422/65 |
| 6,132,582 | A * | 10/2000 | King et al. | ..... | 204/604 |
| 7,381,372 | B2 * | 6/2008 | Sentoh | ..... | 422/100 |
| 2001/0039058 | A1 * | 11/2001 | Iheme et al. | ..... | 436/180 |

* cited by examiner

*Primary Examiner* — Jyoti Nagpaul
(74) *Attorney, Agent, or Firm* — Manabu Kanesaka

(57) ABSTRACT

A microchip processing apparatus processes a microchip with at least one main separation channel. The microchip processing apparatus includes a holding part configured to hold the microchip, a container containing a sample or a reagent, and a dispensing probe having a needle formed on a tip of the dispensing probe. The dispensing probe is actuated to be inserted into the container from above the container, to draw the sample or reagent, and to inject to a prescribed position on the held microchip. A dispensing probe driving mechanism moves the dispensing probe between prescribed positions of the microchip and the container.

13 Claims, 17 Drawing Sheets

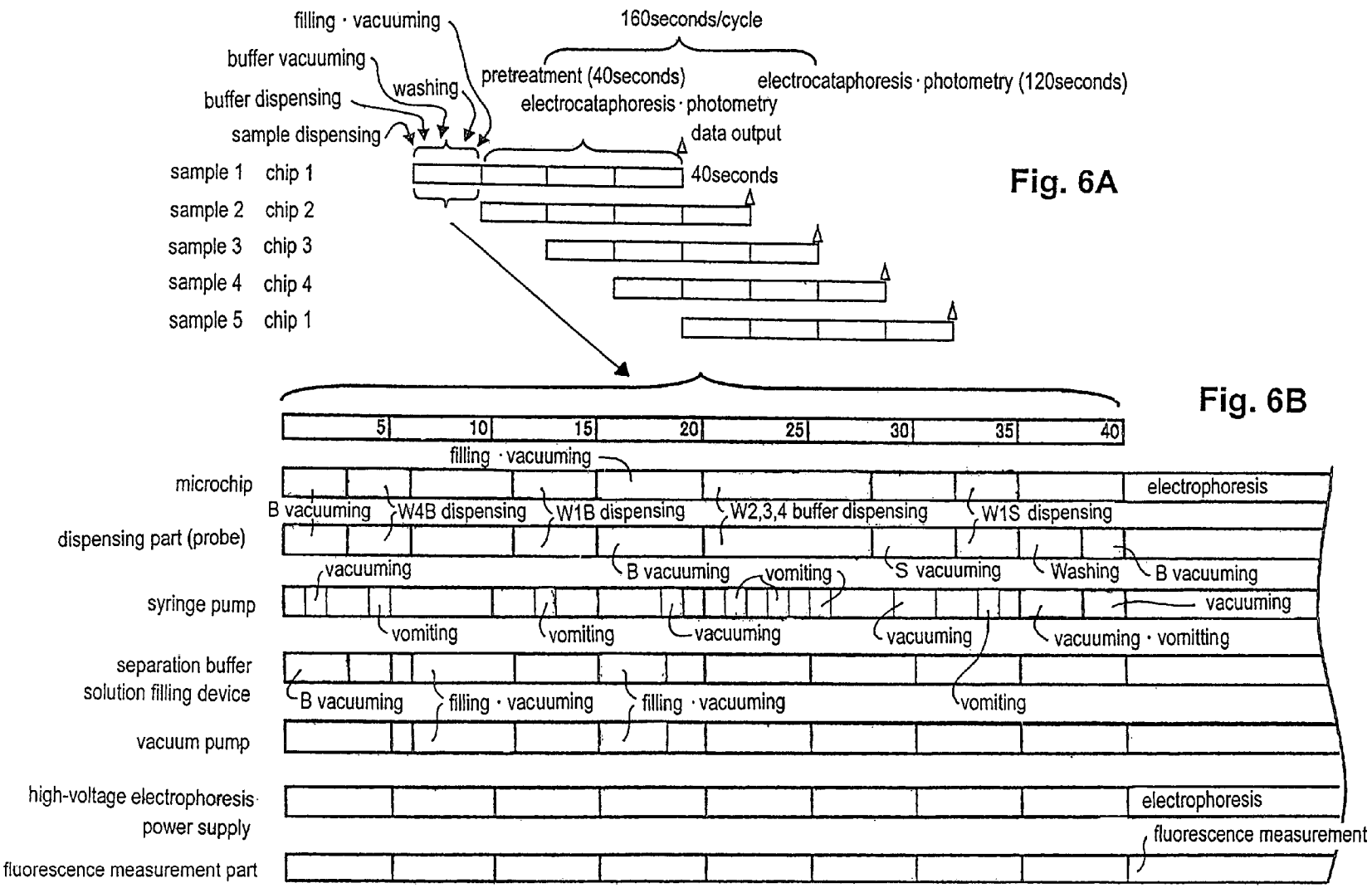
160seconds/cycle
pretreatment (40seconds)
electrocataphoresis · photometry
electrocataphoresis · photometry (120seconds)
data output
40seconds
filling · vacuuming
washing
buffer vacuuming
buffer dispensing
sample dispensing
sample 1 chip 1
sample 2 chip 2
sample 3 chip 3
sample 4 chip 4
sample 5 chip 1
Fig. 6A
Fig. 6B
5
10
15
20
25
30
35
40
microchip
dispensing part (probe)
syringe pump
separation buffer solution filling device
vacuum pump
high-voltage electrophoresis power supply
fluorescence measurement part
B vacuuming
W4B dispensing
filling · vacuuming
W1B dispensing
W2,3,4 buffer dispensing
W1S dispensing
B vacuuming
vomiting
S vacuuming
Washing
B vacuuming
vacuuming
vomiting
vacuuming
vacuuming · vomitting
vomiting
filling · vacuuming
electrophoresis
fluorescence measurement

MICROCHIP PROCESSING APPARATUS

BACKGROUND OF THE INVENTION AND RELATED ART STATEMENT

The present invention relates to a microchip processing apparatus for performing analysis by a method, such as microchip electrophoresis method and micro liquid chromatography.

The microchip processing apparatus comprises at least a holding part for holding a microchip, the holding part having at least a main separation channel in which analysis is performed while a solution moves inside a plate-like member, a dispensing probe for drawing a sample or a reagent, the probe being inserted from above into a container having a sample or a reagent and injecting to a prescribed position on the microchip held by the holding part, and a dispensing probe driving mechanism for moving the dispensing probe between prescribed positions of the microchip and the container.

In microchip electrophoresis, a sample such as DNA, RNA or protein introduced on one side of a main separation channel is electrophoretically separated toward the other end of that channel by voltage applied to both ends of that channel.

In microchip electrophoresis, an apparatus that automatically performs filling of buffer solution, dispensing of samples, electrophoresis, and detection of separated sample components by repeatedly using a single microchip having one electrophoresis channel has been developed (see Patent Document 1).

Furthermore, electrophoresis apparatus having plural channels in order to raise operating efficiency of analysis also have been proposed. For example, Non-Patent Document 1 discloses an apparatus having 12 channels, and after manually performing filling of the separation buffer solution and dispensing of the samples, it electrophoretically separates them sequentially from the 12 channels and obtains data.

Non-Patent Document 2 discloses another device having 12 channels using capillaries, and it is made so as to automatically perform filling of separation buffer solution, dispensing of samples, electrophoretic separation, and data acquisition.

In micro liquid chromatography, the microchip has a liquid delivery channel including a separation channel as a main channel, and separates and analyzes a sample introduced to one side of the separation column by moving it toward the other end of the separation channel (see Non-Patent Document 3).

Patent Document 1: Japanese Patent Publication No. H10-246721

Non-Patent Document 1: "Bunseki" [Analytical Sciences], No. 5, pp. 267-270 (2002)

Non-Patent Document 2: Electrophoresis 2003, 24, 93-95

Non-Patent Document 3: Anal. Chem., 70, 3790 (1998)

SUMMARY OF THE INVENTION

In the case of analyzing biological samples such as DNA and RNA, the quantity of sample contained in the sample container that is dispensed to the microchip is normally a minute quantity, e.g., several μL. Therefore, when the sample container is installed in the microchip processing apparatus, modification of the sample by evaporation can occur if the sample container is left in an open state.

Therefore, one purpose of the present invention is to provide a microchip processing apparatus that is suitable for handling a sample container containing minute quantities of samples.

For example in electrophoretic analysis, the separation buffer solution is repeatedly dispensed into multiple channels. Therefore, it is necessary to measure in advance the buffer solution, before pouring it into the reagent container. If due to human error the analysis is continued in a condition when the quantity of separation buffer solution is insufficient, the analytical results will suffer. If an excess of separation buffer solution is poured into the container to avoid such a situation, wasteful consumption of separation buffer solution will occur, and the size of the reagent container may also increase.

Also, if the analysis is continued in a condition when the quantity of separation buffer solution is insufficient and the analytical results are poor, the sample is wasted.

Therefore, a second purpose of the present invention is to reduce the wasteful consumption of reagents, such as separation buffer solution, as well as the wasteful consumption of samples.

The first purpose of the microchip processing apparatus of the present invention includes a holding part for holding a microchip having at least a main separation channel in which analysis is performed while a solution moves inside a plate-like member. It further includes a dispensing probe for drawing a sample or a reagent, the dispensing probe inserted from above into a sample container or a reagent container and injecting to a prescribed position on the microchip held by the holding part. A dispensing probe driving mechanism is included for moving the dispensing probe between prescribed positions of the microchip, the sample container, and the reagent container.

The dispensing probe forms a needle at the tip, and is commonly used by samples and reagents. The sample container has an upper opening and is installed in the microchip processing apparatus in a state having its upper opening closed by a seal material capable of being penetrated by the needle. The reagent container comprises an upper opening and is installed in the microchip processing apparatus in a state of having its upper opening opened and is configured such that the needle penetrates the seal material to perform drawing the sample during the sample dispensing operation.

One example of the seal material of the sample container is a septum or aluminum sheet, but it is used in a general sense to include also a lid that can be penetrated by the needle.

The reagent contained in the sample container is, in the case of electrophoretic analysis, a separation buffer and, in the case of liquid chromatography, a mobile phase.

If when drawing the sample such that the dispensing probe was inserted into the sample container penetrating the seal material of the sample container, and the seal material and the dispensing probe are close together and there is no gap between them, the inside of the sample container may become negatively pressurized accompanying drawing of the sample, and the analytical precision may be decreased without being able to imbibe the correct amount of sample.

In order to solve such problem, in another aspect of the present invention, the dispensing probe has a groove on its side surface, the groove being placed in a position where the inside of the sample container and the atmosphere communicate when the tip is inserted into the sample container to imbibe the sample.

The groove should be in a position where the inside of the sample container and the atmosphere communicate when drawing the sample. Although there is no need for the groove to extend from the base of the probe to the tip of the probe, in some aspects, it may indeed extend from the base to the tip. Also, the shape of the groove may be a shape such that the inside of the sample container and the atmosphere communicate at the part penetrating the seal material.

When dispensing the sample, because the dispensing probe is inserted into the sample container penetrating the seal material of the sample container, the sample container may be pulled up by friction between the seal material and the dispensing probe when raising the dispensing probe after drawing the sample. Such a situation may become an impediment when the dispensing probe moves.

In yet another aspect of the present invention for solving this problem, the dispensing probe driving mechanism has a restraining mechanism for forcing downward so as not to come up when the dispensing probe is pulled out from the sample container.

In a preferred example, the restraining mechanism is slidably attached to a probe holder for holding the dispensing probe and configured to move in the vertical direction. Furthermore, it has a forcing means for forcing the restraining mechanism downward, and a stopper for restricting the lower end of the restraining mechanism from moving further downward from the lower end of the dispensing probe. Thus the restraining mechanism and the dispensing probe are driven by a single-axis drive system for moving the probe holder in the vertical direction.

In the situation wherein the lid comprising the reagent container containing the separation buffer solution, or the like, is made of resin and is hard, the dispensing probe may penetrate the seal material of the sample container, but it cannot penetrate the lid of the reagent container. Such a hard lid that cannot be penetrated by the dispensing probe is called an "outer lid," and it is distinguished from the seal material. If, when installing in this microchip processing apparatus, the reagent container is mistakenly installed with the outer lid on and the reagent dispensing operation is executed, the dispensing probe may be pushed against the outer lid of the reagent container and be broken.

In yet another aspect of the present invention for solving such problem, the dispensing probe driving mechanism holds the dispensing probe such that is capable of sliding on a vertically moving probe holder, and it has a second forcing means for forcing the dispensing probe downward against the probe holder. The drive mechanism further comprises a position sensor for detecting that the dispensing probe was displaced upward by a prescribed amount against the probe holder.

This position sensor must be made so as not to sense an abnormality when the dispensing probe penetrates the seal material of the sample container. Accordingly, another aspect would include the second forcing means setting a force such that the dispensing probe is not displaced to the operating position of the position sensor when the needle penetrates the seal material of the sample container, and the dispensing probe is displaced to the operating position of this position sensor when the needle collides with something harder than the seal material of the sample container.

Non-limiting, the forcing strength of the second forcing means may be set not only thusly, but also may be set such that the dispensing probe is displaced to the operating position of the dispensing probe when the needle penetrates the seal material of the sample container. In that case, the operation of the position sensor should be controlled such that the position sensor operates during the reagent dispensing operation but does not operate during the sample dispensing operation.

In this aspect, it is preferable that the dispensing probe driving mechanism be controlled so as to stop the dispensing operation during operation of the position sensor.

The microchip processing apparatus of the present invention for achieving the second purpose is a microchip processing apparatus, comprising at least a holding part for holding a microchip including at least a main separation channel in which analysis is performed while a solution moves inside a plate-like member. A dispensing probe is included for drawing a sample or a reagent by being inserting from above into a sample container or a reagent container and injecting to a prescribed position on the microchip held by the holding part. A dispensing probe driving mechanism is configured to move the dispensing probe between prescribed positions of the microchip, sample container, and reagent container, wherein the dispensing probe includes a liquid surface sensor disposed on its tip.

A preferred example of the liquid surface sensor is an electrostatic capacitance type sensor.

The apparatus preferably includes a remaining liquid quantity display part for calculating and displaying the quantity of remaining liquid inside the reagent container based on the output of the liquid surface sensor.

Furthermore, the apparatus may include has a warning means for calculating the quantity of liquid remaining inside the reagent container based on the output of the liquid surface sensor. The warning means further is configured to make it known if the quantity of liquid remaining is insufficient before starting analysis.

Furthermore, the apparatus may include a warning means for calculating the quantity of liquid remaining inside the reagent container based on the output of the liquid surface sensor and further may make it known whenever the quantity of liquid remaining is insufficient.

The microchip processing apparatus is not limited with respect to the control of its analytical operation, but, for example, it may be made such that: the holding part holds microchips in a manner such that the number of the main channels becomes a plurality. Furthermore, a control part may be provided in order to control a preprocessing process and an analysis process in the main channels.

The dispensing probe is used by the plural main channels, and it performs the preprocessing process in advance of the analysis process in those main channels. The control part is configured to perform the preprocessing process independently for each main channel in a manner such that it moves to the preprocessing process of the next main channel when the preprocessing process in one main channel is finished. Furthermore the analysis process is performed in parallel in the plural main channels in which the preprocessing process was finished.

According to the microchip processing apparatus, because the sample container is installed in this microchip processing apparatus in a state having its upper opening closed by a seal material capable of being penetrated by the needle, and the needle of the dispensing probe penetrates the seal material of the sample container to perform drawing of the sample during the sample dispensing operation, it is conceivable that a minute quantity of sample can be injected into the microchip thereby preventing drying.

In addition, because the dispensing probe is used by both the samples and reagents, the construction of the apparatus is simplified.

In some aspects, the dispensing probe has a groove allowing the inside of the sample container and the atmosphere to communicate, wherein the inside of the container no longer becomes negatively pressurized during sample drawing, and the sample can be imbibed with good precision improving the analytical precision.

If the dispensing probe driving mechanism has a restraining mechanism that forcing downward so that the sample container does not come up when the dispensing probe is pulled out, there is no longer an impediment to movement of the dispensing probe because of the sample container coming up.

Because the mechanism for driving the dispensing probe becomes simpler if it is made such that the restraining mechanism and the dispensing probe are driven by a drive system for moving the probe holder in the vertical direction, it becomes possible to provide a compact and inexpensive microchip processing apparatus.

If the dispensing probe is configured to slide on the probe holder by operation of the dispensing probe driving mechanism, it is possible, because the tip of the dispensing probe may be detected to be in contact with an obstruction, that the dispensing probe may be detected displaced upward by a prescribed amount against the probe holder. Under such circumstances, it is possible to move to a measure such as stopping dispensing operation.

Also, if the dispensing operation can be stopped when the tip of the dispensing probe has contacted with an obstacle, damage to the dispensing probe may be reduced.

In addition, if the dispensing probe has a liquid surface sensor on its tip, because the remaining liquid quantity is known, there is no longer a need to use an excessive amount of reagent and wasteful consumption may be controlled. Also there is no longer a need to make the sample container larger than necessary. Also, because wasteful measurement caused by insufficiency of reagent becomes less, waste of samples also can be controlled.

If an electrostatic capacitance type sensor is used as the liquid surface sensor, the liquid surface can be detected with only one dispensing probe, and because it can imbibe the reagent at the bottom of the reagent container, the reagent container can be made more compact.

If the remaining liquid quantity inside the reagent container is calculated and displayed based on the output of the liquid surface sensor, insufficiency of reagent will become known to the operator.

If the remaining liquid quantity inside the reagent container is calculated based on the output of the liquid surface sensor and it is made known that the remaining liquid quantity is insufficient before the start of analysis, a situation in which the analysis operation is started in a state of insufficient reagent can be prevented.

The remaining liquid quantity inside the reagent container may be calculated based on the output of the liquid surface sensor and may be known whenever the remaining liquid quantity is insufficient. Accordingly, it may be possible to stop the analysis or notify the operator at the point when the reagent was insufficient.

BRIEF DESCRIPTION OF THE DRAWINGS

FIGS. 6A and 6B are a time chart showing the operation of the microchip electrophoresis apparatus according to FIG. 1.

FIGS. 10A, 10B, and 10C are front views of another embodiment of the dispensing probe driving mechanism, wherein FIG. 10A shows the waiting state, FIG. 10B shows the process of descending for sample drawing, and FIG. 10C shows the state having detected contact with a foreign body.

DETAILED DESCRIPTION OF PREFERRED EMBODIMENTS

Figure 1:
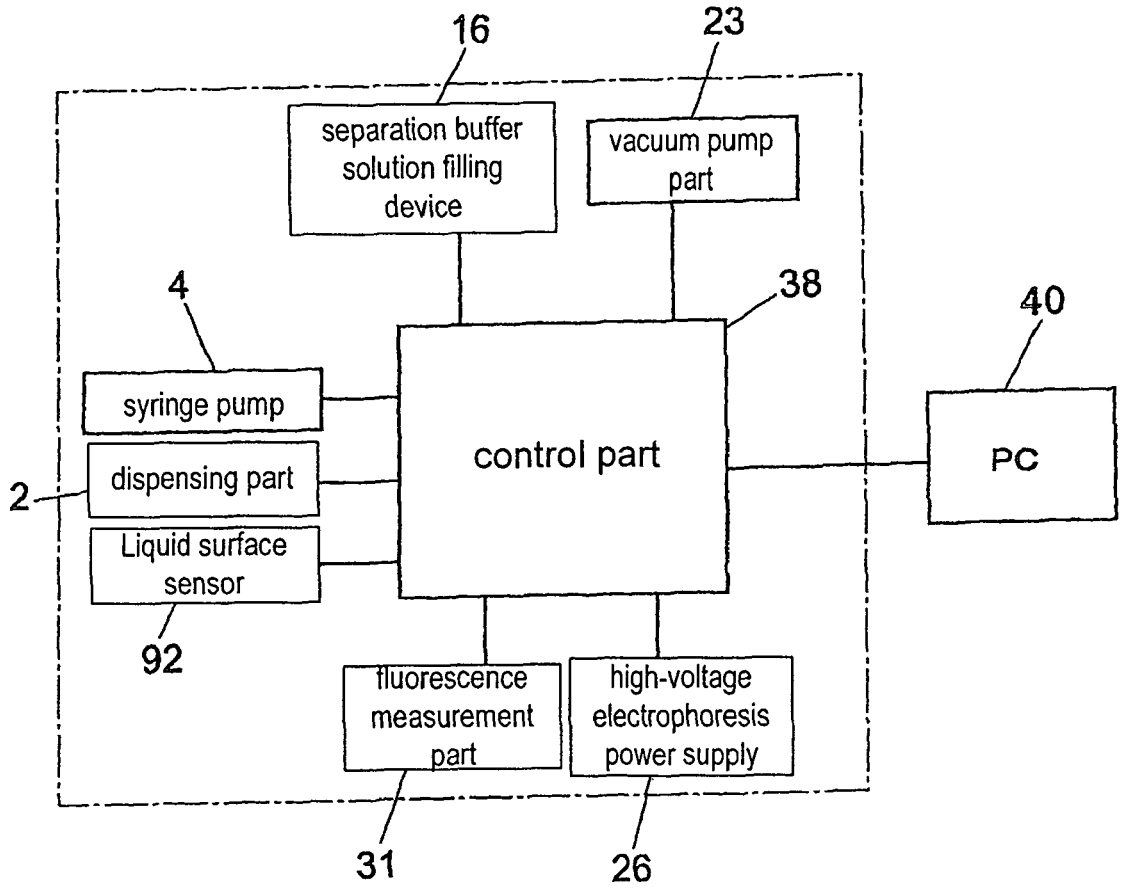
FIG. 1 is a block drawing of a control part in one example of a microchip electrophoresis apparatus according to the present invention.

FIG. 1 is a block diagram of one embodiment of a control part according to one aspect of a microchip electrophoresis apparatus.

Dispensing part 2 includes a dispensing probe driving mechanism having a dispensing probe. The dispensing probe of the dispensing part 2 draws in a separation buffer solution or a sample by a syringe pump 4 and injects it to one end of the electrophoresis channel of the microchip. The dispensing probe is common to a plurality of electrophoresis channels. Separation buffer 16 is a solution filling device in which separation buffer solution, injected into one end of the electrophoresis channel, is filled by air pressure into the electrophoresis channel. Superfluous separation buffer solution is discharged by a vacuum pump part 23, and the separation buffer solution filling device 16 is common to the plural electrophoresis channels in order to perform processing.

In addition, high-voltage electrophoresis power supply 26 applies phoresis voltage independently to the respective electrophoresis channels. Fluorescence measurement part 31 detects sample components separated in the electrophoresis channels.

Control part 38 controls the operation of the dispensing part 2 so as to move to the steps of separation buffer solution filling and sample injection into the next electrophoresis channel when separation buffer solution filling and sample injection into one electrophoresis channel is finished. Control part 38 also controls the operation of the high-voltage electrophoresis power supply part 26 so as to apply a phoresis voltage in order to cause electrophoresis in the electrophoresis channel in which the sample injection was finished. Furthermore, control part 38 controls the operation of detection by the fluorescence measurement part 31.

Personal computer 40 is an external control device for supporting the operations of the microchip electrophoresis apparatus and receiving and processing data obtained by the fluorescence measurement part 31.

Figure 2:
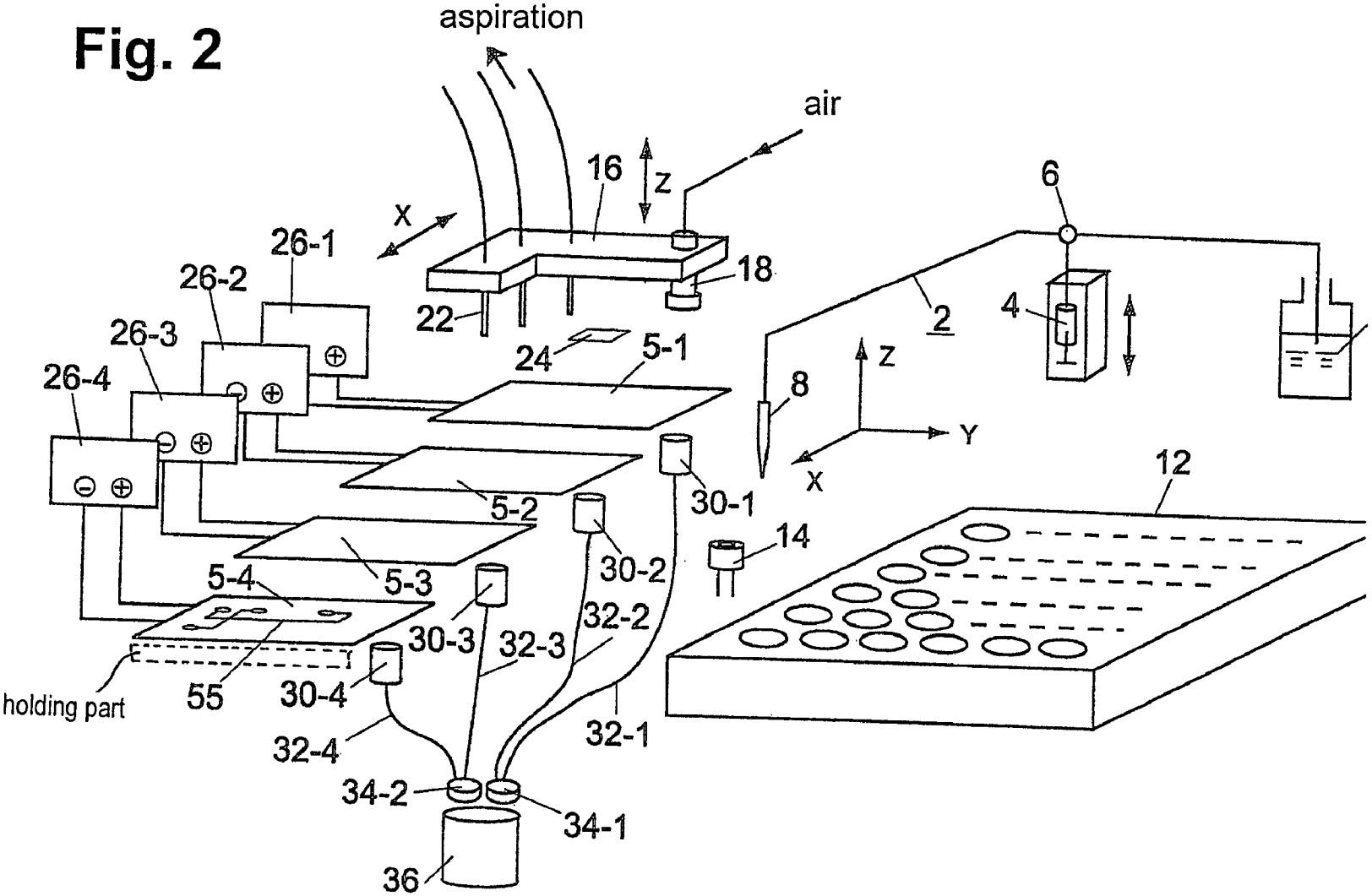
FIG. 2 is an exploded view of the microchip electrophoresis apparatus.

FIG. 2 is an exploded diagram of a microchip electrophoresis apparatus according to one aspect of the microchip electrophoresis apparatus. Four microchips 5-1, 5-2, 5-3, and 5-4 are held by a holding part. The four microchips, as explained in detail later, each have one electrophoresis channel formed for processing one sample.

In order to dispense separation buffer solution and samples to the microchips 5-1 through 5-4, the dispensing part 2 includes a syringe pump 4 for performing suction and ejection, a dispensing probe 8 having a dispensing nozzle, and a wash solution container 10. The dispensing probe 8 and the wash solution container 10 are connected to the syringe pump 4 by means of a three-way electromagnetic valve 6. The separation buffer solution and samples are respectively received in holes on a micro titer plate 12, and they are dispensed to the microchips 5-1 through 5-4 by the dispensing part 2. The separation buffer solution also may be contained in a dedicated container and placed near the micro titer plate 12. Washing part 14 is operable to wash the dispensing probe 8, and it is configured to be overflowing with wash solution.

The dispensing part 2 draws separation buffer solution or sample into the dispensing probe 8. A three-way electromagnetic valve 6 configured to connect the dispensing probe 8 to the syringe pump 4 is operable to eject separation buffer solution or sample into any electrophoresis channel of microchips 5-1~5-4.

Washing the dispensing probe 8 is enabled by switching the three-way electromagnetic valve 6 such that the syringe pump 4 is connected to the wash solution container 10. Wash solution is then drawn into the syringe pump 4 and then the dispensing probe 8 is flooded with wash solution of the washing part 14. The three-way electromagnetic valve 6 is then switched to the side connecting the syringe pump 4 and the dispensing probe 8, thereby ejecting the wash solution from the inside of the dispensing probe 8.

The separation buffer solution filling device 16 is common to the four microchips 5-1~5-4 and is configured to fill the channels with separation buffer solution dispensed into the reservoirs on one end of the electrophoresis channels of the microchips 5-1~5-4. The separation buffer solution filling device 16 is configured to push an air supply port 18 against the reservoir on one end of any electrophoresis channel of the microchips 5-1 to 5-4 to maintain air-tightness. Device 16 then inserts suction nozzles 22 into the other reservoirs, and blows air from the air supply port 18 in order to push the separation buffer solution into the electrophoresis channel. Separation buffer solution overflowing from the other reservoirs is then drawn by the vacuum pump from the nozzles 22 and ejected to the outside.

A high-voltage electrophoresis power supply 26-1~26-4, provides an independent power supply for each microchip 5-1~5-4, and applies a phoresis voltage independently to the electrophoresis channel of each microchip 5-1~5-4.

The fluorescence measurement part 31, configured to detect the sample component electrophoretically separated in the separation channel 55 of the microchip 5-1~5-4, comprises: LEDs (light-emitting diodes) 30-1 to 30-4 that are provided for each microchip and radiates excited light on a part of the respective electrophoresis channels; optical fibers 32-1~32-4 that receives fluorescent light generated by excitation of sample components moving in the electrophoresis channels by excited light from the LEDs 30-1~30-4; and a photoelectric amplification tube 36 that receives the fluorescent light by means of a filter 34 operable to remove the excited light component from the fluorescent light from the respective optical fibers 32-1~32-4 and to allow only the fluorescent light portion to pass. By causing the LEDs 30-1 to 30-4 to emit light with the times mutually shifted, it is possible to identify and detect the fluorescent light from the four microchips 5-1~5-4 with one photoelectric amplification tube 36. The light source of the excited light is not limited to LEDs. LDs (laser diodes) and other light sources may also be used.

FIGS. 3A-3C and FIG. 4 show one embodiment of a microchip according to the electrophoresis apparatus of the present invention. The microchip includes an electrophoresis channel formed inside the substrate, and does not necessarily imply being limited to one having a small size.

Figure 3A:
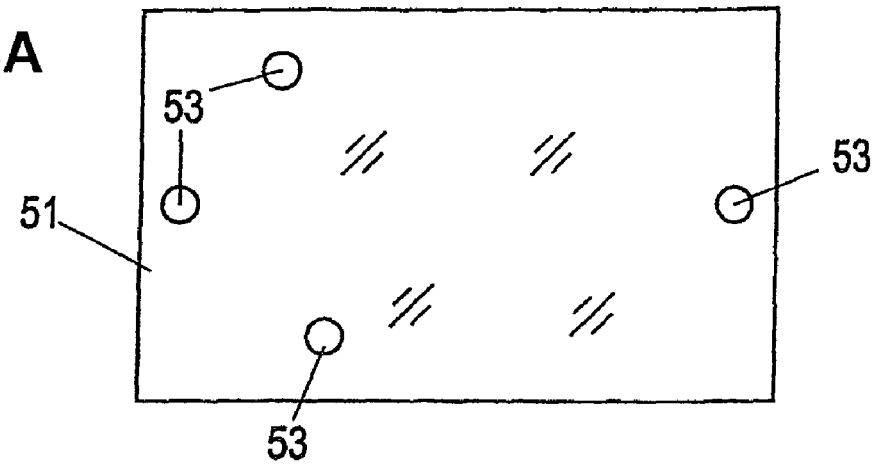
FIGS. 3A and 3B are plan views showing the transparent plate-like member constituting the microchip.
Figure 3B:
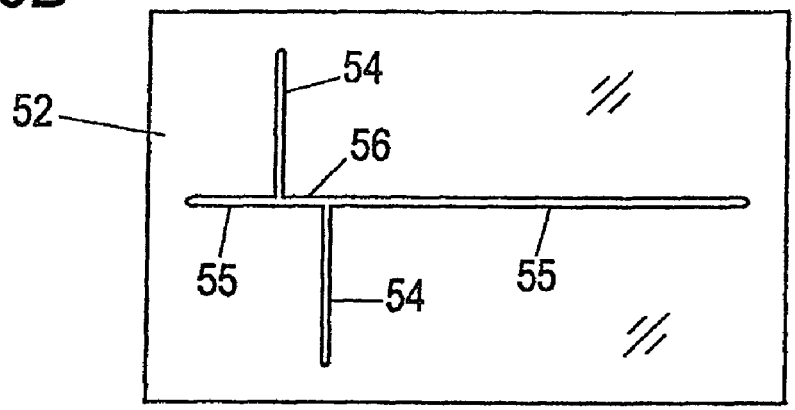
Figure 3C:
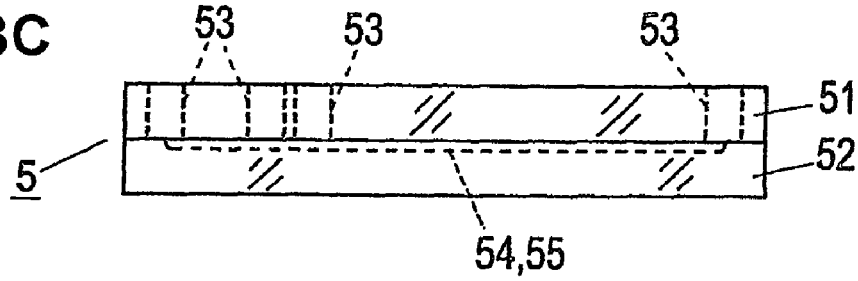
FIG. 3C is a front view of the microchip.

As shown in FIGS. 3A-3C, microchip 5 consists of a pair of transparent substrates (quartz glass or other glass substrates or resin substrates) 51 and 52, and on the surface of one substrate 52, as shown in FIG. 3B, mutually intersecting capillary electrophoresis grooves 54 and 55 are formed. On the other substrate 51, as shown in FIG. 3C, reservoirs 53 are provided as through-holes in positions corresponding to the ends of those grooves 54 and 55. The two substrates 51 and 52 are overlaid and bonded together as shown in FIG. 3C, and the capillary grooves 54 and 55 are used as a separation channel 55 for the electrophoretic separation of samples and a sample introduction channel 54 for introducing samples into that separation channel.

Figure 4:
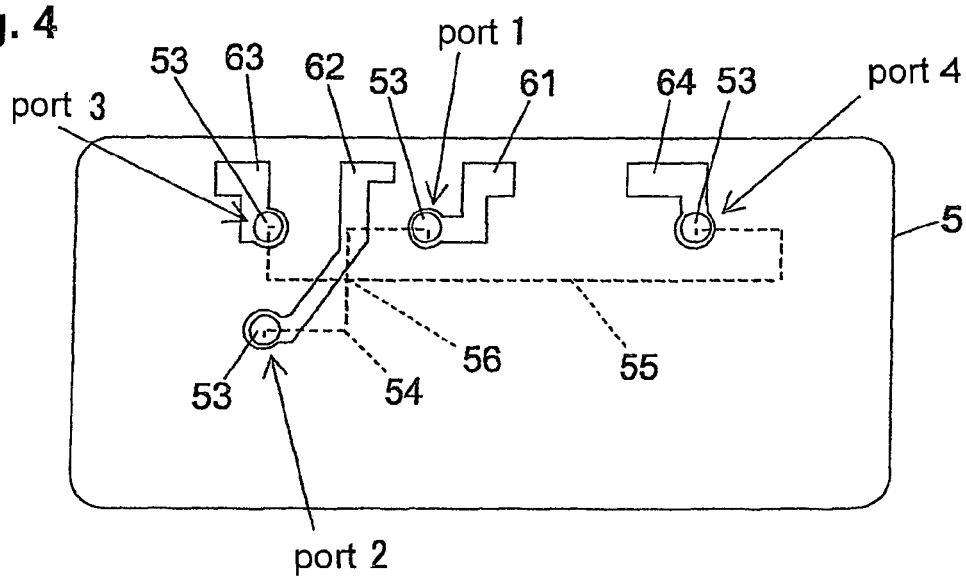
FIG. 4 is a another plan view of a microchip.

In order to make handling easier, the microchip 5 of FIG. 3 may, as shown in FIG. 4, having electrode terminals formed on the chip for applying voltage. The four reservoirs 53 are also ports for applying voltage to the channels 54 and 55. Ports #1 and #2 are positioned on both ends of the sample introduction channel 54, and ports #3 and #4 are positioned on both ends of the separation channel 55. In order to apply voltage to each port, electrode patterns 61-64, formed on the surface of chip 5, are formed extending from the respective ports to the side end parts of the microchip 5, and they are formed so as to be connected to the high-voltage electrophoresis power supply parts 26-1~26-4.

Figure 5:
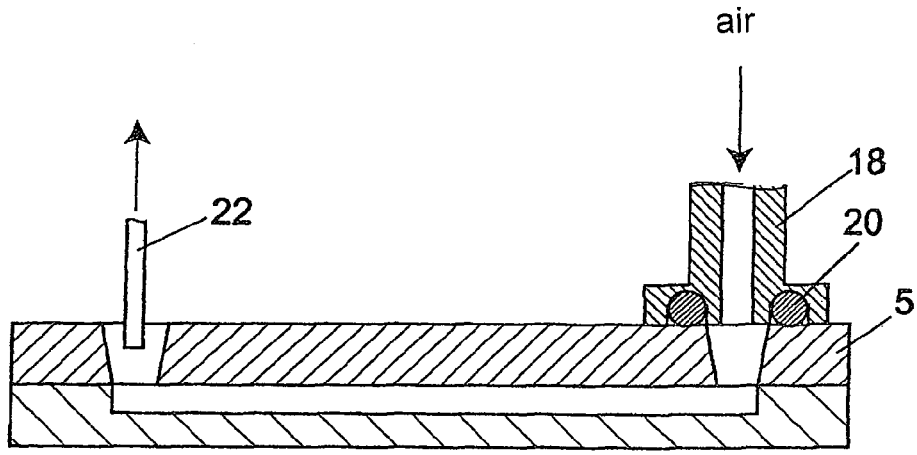
FIG. 5 is a sectional view of the connected state of the air supply port and the microchip when filling the separation buffer solution in the microchip electrophoresis apparatus.

FIG. 5 shows the connected state of the air supply port 18 on the buffer filling/discharging part 16 and the microchip 5. An O-ring 20 is provided on the front end of the air supply port 18, and by pushing the air supply port 18 onto one reservoir of the microchip 5, the air supply port 18 can be attached to the electrophoresis channel of the microchip 5. Maintaining an air-tight seal, air can be pressurized and sent into the channel from the air supply port 18. The nozzles 22 are connected to the other reservoirs, and the superfluous separation buffer solution overflowing from the channels is drawn and discharged.

FIGS. 6A and 6B illustrates the operation of one embodiment of the microchip processing apparatus, wherein only one electrophoresis channel is formed on one microchip. Therefore, in this case, moving from the processing one microchip to the next microchip is the same as moving from one electrophoresis channel to the next electrophoresis channel.

FIG. 6A illustrates a preprocessing process and an electrophoresis/light-measurement process being performed sequentially, while partially in parallel, on four microchips.

Each process is set according to time: the preprocessing process is set to 40 seconds; the electrophoresis/light-measurement process to 120 seconds; and one cycle for one microchip is 160 seconds.

When the preprocessing process for one microchip is finished, the processing process moves to the next microchip without waiting for the end of the electrophoresis/light measurement process on the former microchip. That is, at the end of the preprocessing process on the first microchip, accompanying the start of electrophoresis and light measurement on the first microchip, the preprocessing process is begun on the second microchip.

When the preprocessing process on the second microchip is finished, electrophoresis and light measurement on the second microchip is started, and in addition, the preprocessing process on the third microchip is started. The preprocessing process is performed sequentially for each microchip, and independently, electrophoresis and light measurement is started sequentially on a microchip having finished the preprocessing process. As a result electrophoresis and light measurement may be performed in parallel on multiple microchips. While the preprocessing process is being performed on higher number microchip, the analysis may be finished on the first microchip. Accordingly, the first microchip may be reused and the processing may be repeated.

In the electrophoresis process, application of voltage in order to lead the sample from the sample introduction channel to the position of intersection with the separation channel is performed. Electrophoretic separation by application of voltage in the separation channel is then performed. Light radiation from the LED is then performed in the detection position, and fluorescence measurement is started.

The preprocessing process is shown in detail in FIG. 5B wherein the uppermost numbers represent time in seconds. The "microchip" fields indicate the contents of the processing in one microchip, and the "dispensing part" fields indicate the operations of drawing and ejecting of separation buffer solution and samples from the dispensing probe 8 by operation of the syringe pump 4.

The "separation buffer solution filling device" fields indicate the filling operation of pushing the separation buffer solution dispensed to the microchip into the channel and the operation of performing the drawing process of drawing and discharging the overflowing separation buffer solution by the suction pump.

In the "microchip" fields, the first separation buffer solution drawing (FIG. 5B) comprises drawing and discharging the separation buffer solution used in analysis. In the next "W4B dispensing" operation, the separation buffer solution is dispensed to the fourth reservoir.

In the next "filling/drawing" process, pressurized air is supplied from the separation buffer solution filling device and that separation buffer solution is pushed into the electrophoresis channel. Furthermore, the superfluous separation buffer solution is drawn in and discharged from the other reservoirs whereby the channels are washed with new separation buffer solution.

By the next "W1B dispensing" process, new separation buffer solution is dispensed into the first reservoir in order to wash the first reservoir. In the next "filling/drawing" process, pressurized air is supplied to the fourth reservoir from the separation buffer solution filling device and that separation buffer solution is pushed into the electrophoresis channel. In addition, the superfluous separation buffer solution is drawn in and discharged from the other reservoirs whereby the separation buffer solution is filled into the channels.

After that, by the next "W2, 3, 4 buffer dispensing" processes, the separation buffer solution is dispensed from the other second, third, and fourth reservoirs. With this, filling of separation buffer solution into the electrophoresis channels is completed.

Next, the sample is drawn into the dispensing probe of the dispensing part for dispensing of the sample, and by the "W1S dispensing" process, sample dispensing is performed by ejection of the sample in the first reservoir. After sample dispensing, the dispensing probe of the dispensing part is washed, and then it prepares for drawing in the separation buffer solution for the next sample. With this, the preprocessing process in the electrophoresis channels of the microchip is finished.

In one embodiment, the microchip includes an electrophoresis channel and cross injection method is used. Nonlimiting, the microchip may only comprise a separation channel.

Furthermore, although the above disclosed microchip includes one electrophoresis channel disposed on one microchip, in other embodiments, multiple electrophoresis channels may be formed on one microchip. In that case, the present invention should be applied with the electrophoresis channels as a unit.

In addition, the above apparatus and method used a detection part that measures fluorescence. However, in addition to measuring fluorescence, it is possible to measure light absorption or use a detection method based upon chemical light emission or biological light emission.

Regarding the detection part, even if it is not one which radiates excited light independently for each microchip, it also may be a method in which a light measurement system used commonly by all microchips is prepared, and that optical system scans movement among the detection positions of all of the microchips.

Next the dispensing part 2 is explained in detail.

Figure 7:
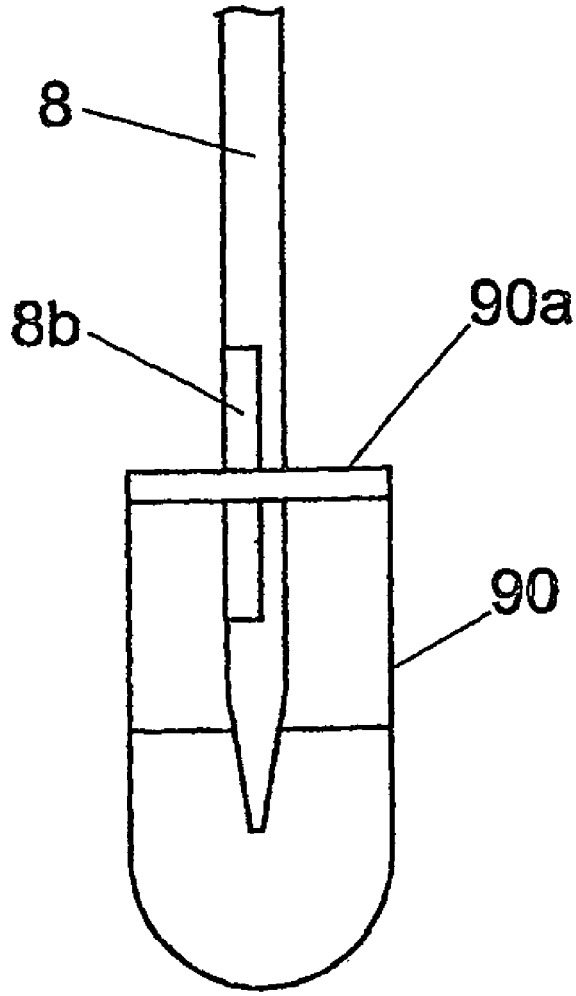
FIG. 7 is a summary front view showing the dispensing probe according to the apparatus of FIG. 1.

As shown in enlargement in FIG. 7, the dispensing probe 8 is hollow and the tip forms a needle. Drawing and ejecting of liquid is performed from a hole on the tip. The dispensing probe 8 is used by both samples and reagents, e.g., the separation buffer solution. FIG. 7 shows a state in which the tip of the dispensing probe 8 is inserted into the sample container 90. The sample container 90, is installed in this microchip processing apparatus in a state having its upper opening closed by a seal material 90*a*, such as a septum, that can be penetrated by the needle tip of the dispensing probe 8.

Alternatively, the reagent container containing the separation buffer solution may be installed in this microchip processing apparatus in a state wherein the upper opening is opened by removal of the outer lid. During the sample dispensing operation, the needle of the dispensing probe 8 is inserted into a sample container 90, penetrating the seal material 90*a* and drawing of the sample is performed. During reagent dispensing, the needle of the dispensing probe 8 is inserted into an opened reagent container and drawing of the reagent is performed.

The dispensing probe 8 may have a groove 8*b* on its side surface, having, for example, both a width and a height of 50 μm-0.6 mm, and is positioned where the inside of the sample container 90 and the atmosphere communicate when the tip of the dispensing probe 8 is inserted into the sample container 90 to draw in the sample, i.e., the position where it is penetrating the seal material 90*a*. Because the atmosphere flows into the container 90 through the groove 8*b*, even when the sample inside the container 90 is drawn by the dispensing probe 8, it is possible to prevent the inside of the container 90 from being negatively pressurized. Furthermore, the liquid can be drawn with more precision.

The dispensing probe 8 may be made of metal, and serves as an electrostatic capacitance type liquid surface sensor by detection of the electrostatic capacitance at its tip part. In one exemplary embodiment, the tip part of the dispensing probe 8 is formed as a dual tube with a mutually insulated inner tube and outer tube being provided coaxially, thus forming a capacitance type liquid surface sensor.

The electrostatic capacitance of the tip part of the dispensing probe 8 detects the liquid surface by a change in capacitance when the tip part is inserted into the sample container or the reagent container and makes contact with the liquid inside the container. The liquid surface sensor, as indicated by symbol 92 in FIG. 1, is connected to the control part 38, and by regularly monitoring the electrostatic capacitance, the position of the liquid surface inside the sample container or the reagent container is sensed.

Figure 8:
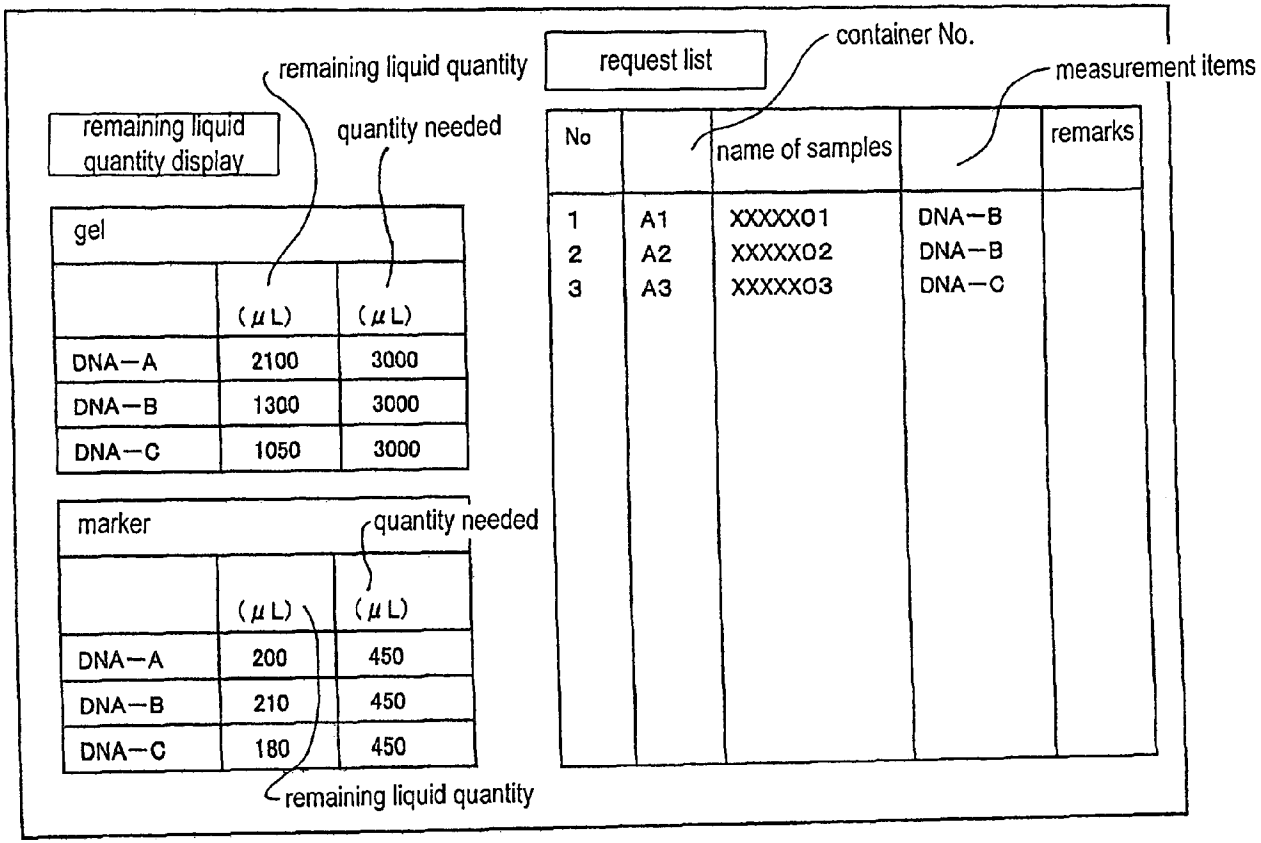
FIG. 8 is a drawing showing one example of the display screen for displaying the remaining liquid quantity in the reagent container.

The control part 38 calculates the quantity of liquid remaining inside the sample container or inside the reagent container based on the output of the liquid surface sensor, and generates a display, as shown in FIG. 8, comprising a personal computer (PC) 40 as the remaining liquid quantity display component.

Furthermore, in the event that the quantity of liquid remaining, based on the output of this liquid surface sensor, is insufficient before the start of analysis, the control part 38 may indicate this condition using the personal computer 40 as a warning means.

Similarly, in the event that the quantity of liquid remaining, based on the output of this liquid surface sensor is insufficient, the control part 38 may indicate this condition at that time using the personal computer 40 as a warning means.

Figure 9C:
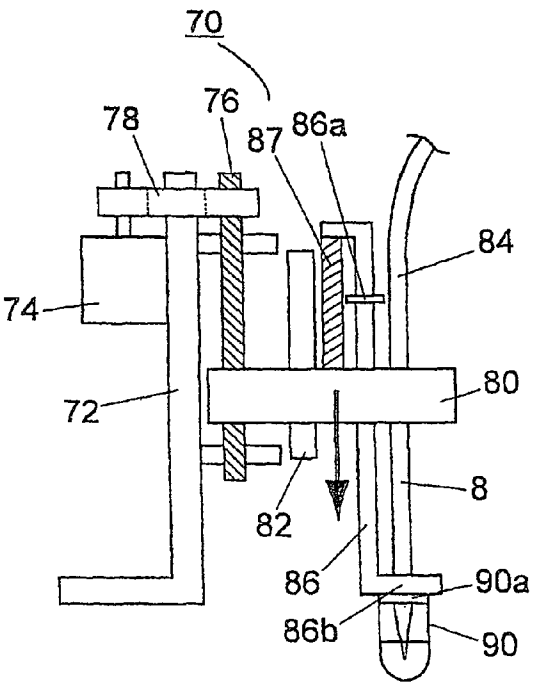
FIG. 9C is another front view of the dispensing probe driving mechanism in a sample drawing position.
Figure 9B:
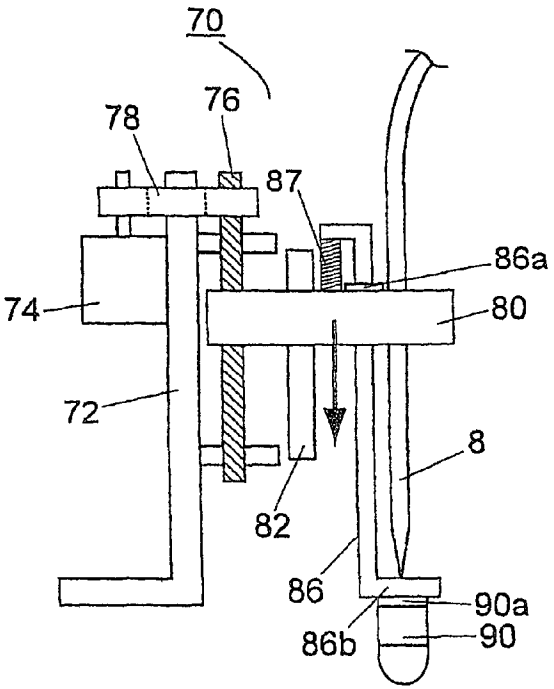
FIG. 9B is another front view of the dispensing probe driving mechanism in the process of descending to imbibe a sample.
Figure 9A:
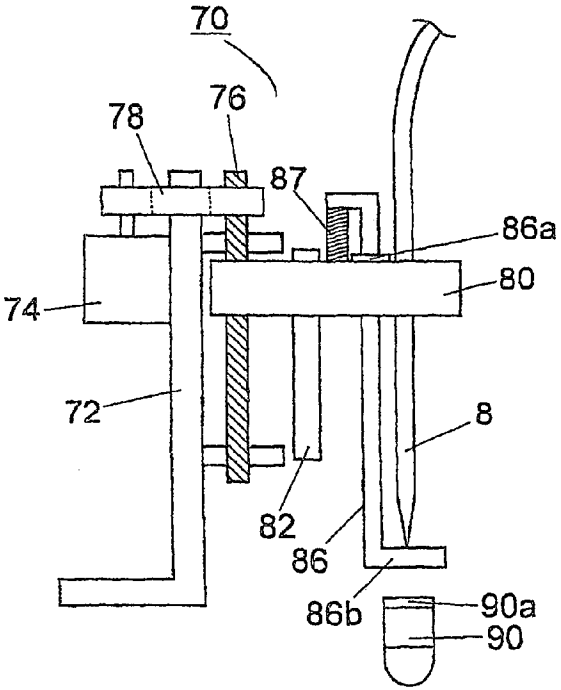
FIG. 9A is a front view of one embodiment of the dispensing probe driving mechanism in a waiting position.

FIGS. 9A-9C show an example in which the dispensing probe driving mechanism in the dispensing part 2, has on its lower end, a restraining lever 86 as a restraining mechanism. Restraining lever 86 includes a horizontal restraining member 86*b* that forces downward so that the sample container 90 does not come up when the dispensing probe 8 is driven in the Z direction (vertical direction) and the dispensing probe 8 is then pulled out from the sample container 90.

The restraining lever 86 is attached to be capable of sliding on a probe holder 80, and is configured to hold the dispensing probe 8 and move in the vertical direction. Restraining lever 86 includes a spring 87 as a forcing means for forcing the restraining lever 86 downward against the probe holder 80, and further includes a stopper 86*a* for restricting the restraining lever 86*b* from moving further downward from the stopping position (position in the state in FIG. 9A) of the lower end of the dispensing probe 8 against the probe holder 80. The stopper 86*a* is fixed on the restraining lever 86 above the probe holder 80, and by contact with the upper surface of the probe holder 80, the restraining lever 86 is restricted from moving further downward. The spring 87 is a tension spring, and may be hung above the probe holder 80, between the upper end of the restraining lever 86 and the probe holder 80.

The restraining lever 86 and the dispensing probe 8 may be driven by a single-axis drive system configured to move the probe holder 80 in the vertical direction. Explaining this mechanism in further detail, the driving part 70 is configured to drive the dispensing probe 8 and has a fixed shaft 72 which is fixed to a driving mechanism (not illustrated) for moving driving part 70 in the X direction and Y direction on a horizontal plane. A horizontal linear guide 82 is fixed on the fixed shaft 72, and the probe holder 80, guided by the linear guide 82, slidably supported in the vertical direction.

A ball screw 76 is fitted on the probe holder 80 and is configured to drive the movement of the probe holder 80 in the vertical direction. Furthermore, a drive motor 74, such as a stepping motor, is attached on the fixed shaft 72, and the rotating shaft of the drive motor 74 and the ball screw 76 are linked by a timing belt 78, whereby the rotation of the drive motor 74 is transmitted to the ball screw 76.

The operation of drawing a sample with the dispensing probe 8 by the dispensing part in FIGS. 9A-9C is explained.

Waiting State

The position in FIG. 9A is the waiting position, and in the waiting position, the probe holder 80 is raised to the uppermost position, and the restraining lever 86 has become in the state most descended against the probe holder 80 with the stopper 86*a* of the restraining lever 86 in contact with the upper surface of the probe holder 80. In this waiting state, the restraining member 86*b* at the lower end of the restraining lever 86 has come further downward from the tip of the dispensing probe 8.

Descent for Sample Drawing

FIG. 9B shows the state wherein the dispensing probe 8 descends. The rotation of the drive motor 74 is transmitted to the ball screw 76 by means of the timing belt 78, and the ball screw 76 rotates whereby the probe holder 80 descends. Because the dispensing probe 8 is fixed to the probe holder 80, it descends together with the probe holder 80. Also, because the restraining lever 86 is forced downward against the probe holder 80 by the spring 87, the restraining lever 86 also descends together with the probe holder 80. The descent of the restraining lever 86 stops when the restraining member 86*b* at the lower end of the restraining lever 86 makes contact with the upper surface of the sample container 90.

Sample Drawing

The probe holder 80 continues to descend further from the state in FIG. 9B. The restraining lever 86 cannot descend further because the restraining member 86*b* on its lower end is in contact with the sample container. In addition, the restraining lever 86 slides against the probe holder 80 accompanying the descent of the probe holder 80, and only the probe holder 80 continues to descend stretching spring 87. The dispensing probe 8 descends together with the probe holder 80, and its tip is inserted into the sample container 90, penetrating the seal material 90*a* of the sample container 90.

The driving of the drive motor 74 is stopped at a place where it has intruded into the sample by a prescribed depth, stopping the descent of the probe holder 80 at a position indicted in FIG. 9C. It is in this state that a prescribed quantity of sample is drawn in by the dispensing probe 8.

Next, the drive motor 74 rotates in the reverse direction, and the probe holder 80 starts to ascend. The dispensing probe 8 starts to ascend accompanying the ascent of the probe holder 80, and it is pulled out from the sample container 90. At this time, because the restraining lever 86 is being forced downward against the probe holder 80 by the spring 87, the restraining lever 86 stops at the position in FIG. 9C, even though the probe holder 80 is starting to ascend. Although a force in an upward direction works on the sample container 90 by friction between the dispensing probe 8 and the seal material 90*a* when the dispensing probe 8 is pulled out from the seal material 90*a* of the sample container 90, the sample container 90 is prevented from coming up because the restraining member 86*b* is fixed, as shown in FIG. 9C.

When the probe holder 80 ascends up to the position shown in FIG. 9B, the stopper 86*a*, attached to the restraining lever 86, makes contact with the upper surface of the probe holder 80. Subsequently, when the probe holder 80 ascends further, the restraining lever 86 ascends together with the probe holder 80. When the probe holder 80 ascends up to the position shown in FIG. 9A, the sample drawing operation is finished.

Afterwards, the entire driving part 70 is moved up to a prescribed position of the microchip, the dispensing probe 8 is inserted into a prescribed reservoir of the microchip, and the sample is injected.

The dispensing probe 8 is used not only for dispensing of samples, but also for dispensing of reagents. Although the reagent in the disclosed embodiments is separation buffer solution, the dispensing probe 8 is the same in the case when using other reagents. The reagent container comprises a container larger than the sample container in order to contain a reagent that is repeatedly dispensed on the microchip, and is installed in the microchip processing apparatus in a state wherein the lid on the open part is removed.

The structure of the dispensing probe 8 is such that it will be inserted into a reagent container with the lid removed. The lid of the reagent container, for example, is made of resin and it is harder compared with the seal material 90*a* of the sample container 90. Furthermore, a concern may exist that if the reagent container is installed in this microchip processing apparatus with the lid of the reagent container attached, the tip of the dispensing probe 8 may be damaged by being pushed against the lid of the reagent container. To prevent such a situation, FIG. 10 shows one embodiment comprising a means for sensing that the dispensing probe 8 has hit the lid of the reagent container.

Figure 10C:
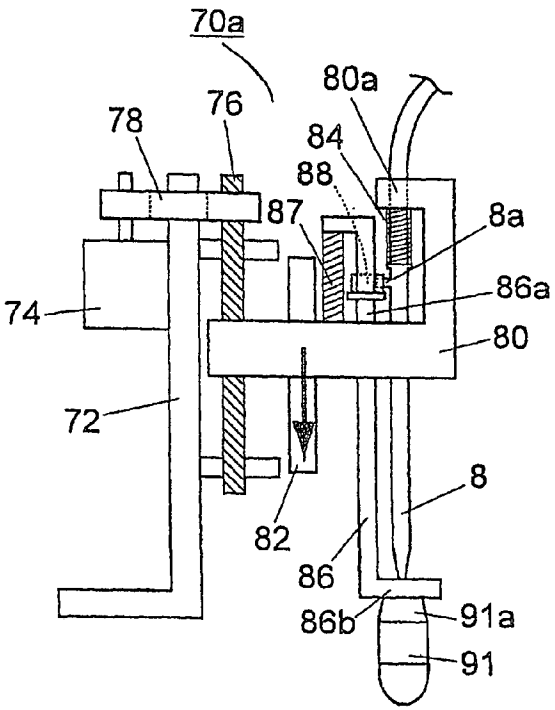
Figure 10B:
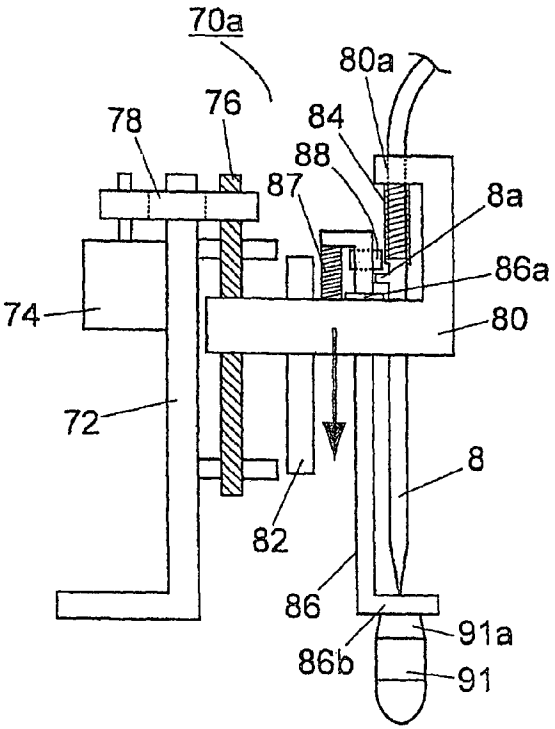
Figure 10A:
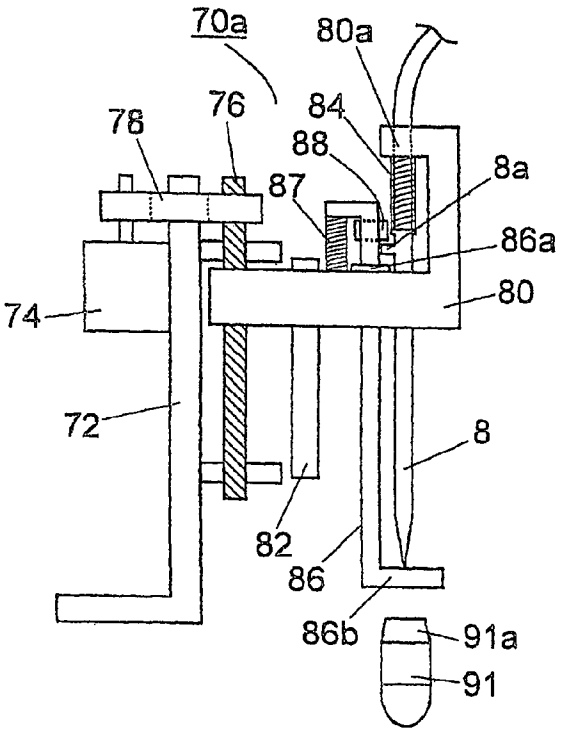

When compared with the driving part 70 in FIGS. 9A-9C, the driving part 70*a* shown in FIGS. 10A-10C differs from the one in FIGS. 9A-9C in the point that the mechanism for holding the dispensing probe 8 against the probe holder 80 is different, and it is provided with a sensor that senses that the tip of the dispensing probe 8 hit the lid.

In the driving part 70*a* in FIGS. 10A-10C, the dispensing probe 8 is held to be capable of sliding against the probe holder 80. The probe holder 80 has an integral L-shaped spring restraining part 80*a* that extends upward. The dispensing probe 8 is supported to be capable of sliding running through the probe holder 80 and the spring restraining part 80*a*. In addition, a compression spring 84 is inserted on the lower side of the spring restraining part 80*a* and forces the dispensing probe 8 downward against the probe holder 80.

In order to detect that the dispensing probe 8 was displaced against the probe holder 80, the dispensing probe 8 is provided with a protruding piece 8*a* on the upper side of the probe holder 80. A position sensor 88, such as a photo sensor, is provided on the probe holder 80 in order to detect that protruding piece 8*a*. The positions of both the protruding piece 8*a* and the position sensor 88 are defined such that the position sensor 88 turns on when the dispensing probe 8 is displaced upward against the probe holder 80 by a prescribed amount.

The sensing operation that determines that the tip of the dispensing probe 8 hit the lid of the reagent container in the embodiment of FIG. 10 is explained.

Although the reagent container 91 should be installed in a state having the lid 91 a removed, for the sake of this example, it is assumed that the container 91 was installed in this microchip processing apparatus with the lid 91 a attached.

FIG. 10A is a waiting state, and from this state as explained relative to FIGS. 9A-9C, the probe holder 80 descends. When the restraining member 86*b* at the lower end of the restraining lever 86 makes contact with the upper surface of the reagent container 91, as in FIG. 10B, the descent of the restraining lever 86 stops. However, the probe holder 80 continues to descend further, whereby the tip of the dispensing probe 8 makes contact with the lid 91*a* of the reagent container 91.

The probe holder 80 and the slidably attached dispensing probe 8 continue to descend until the descent of the dispensing probe 8 is stopped because the dispensing probe 8 cannot penetrate the lid 91*a*. However, the probe holder 80 continues to descend further, sliding against the dispensing probe 8. Because the position sensor 88 is fixed on the probe holder 80, it descends along with the probe holder 80, and, as shown in FIG. 10C, as soon as the position sensor 88 turns on at the place where the position sensor 88 comes up to the protruding piece 8*a*, it is sensed that the tip of the dispensing probe 8 has made contact with a hard object. In this state the descent of the probe holder 80 is stopped, and the dispensing operation is stopped.

Figure 11A:
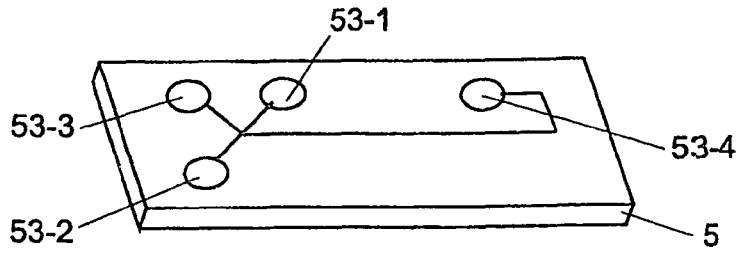
FIGS. 11A-11U are perspective views showing the operation of one embodiment according to the apparatus of FIG. 1.
Figure 11B:
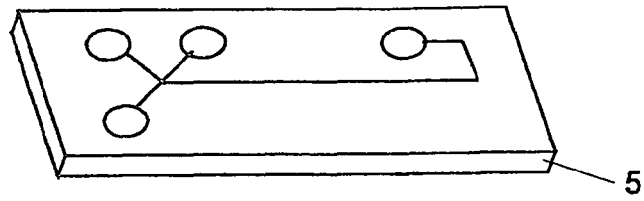
Figure 11C:
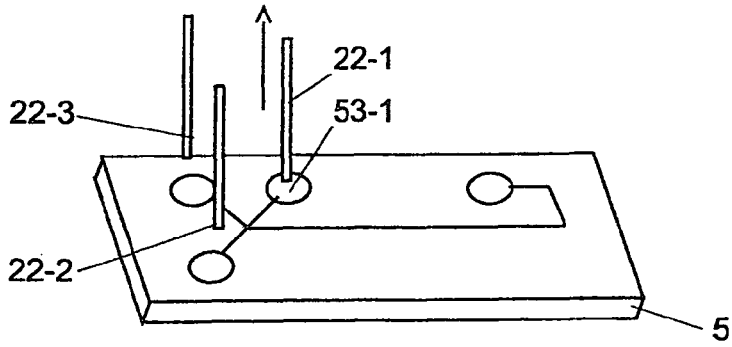
Figure 11D:
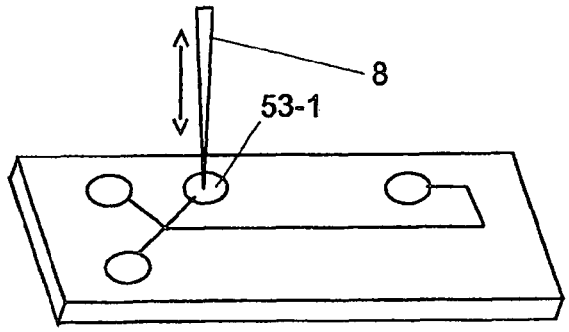
Figure 11E:
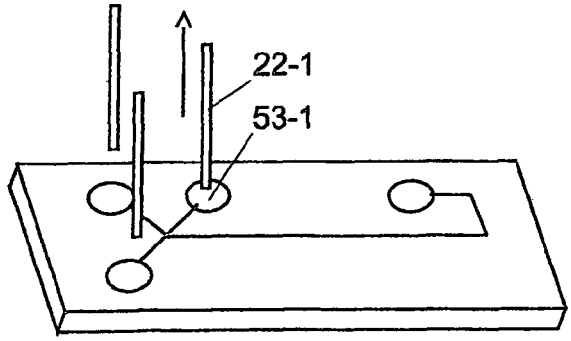
Figure 11F:
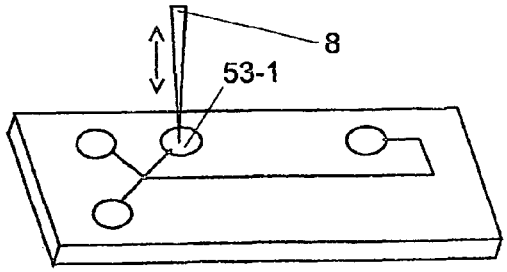
Figure 11G:
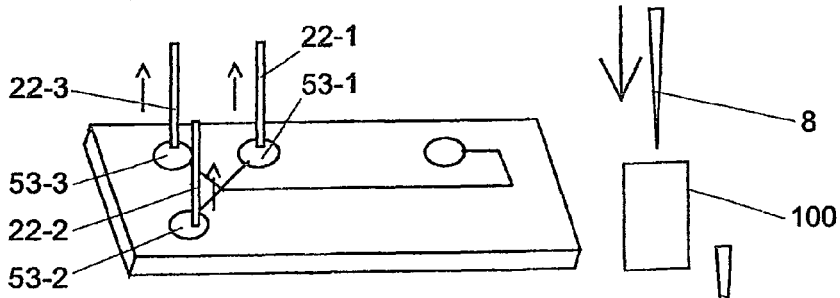
Figure 11H:
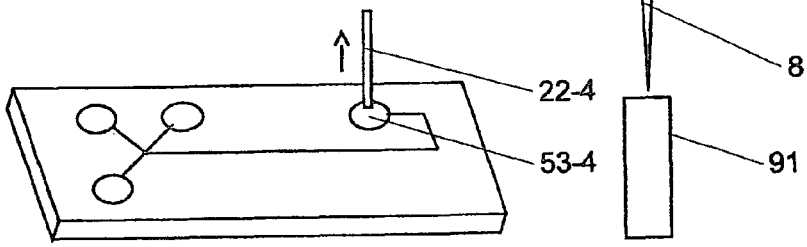
Figure 11I:
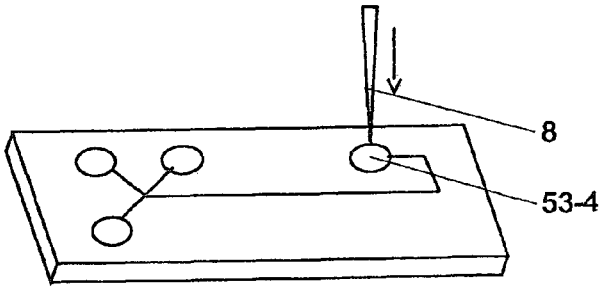
Figure 11J:
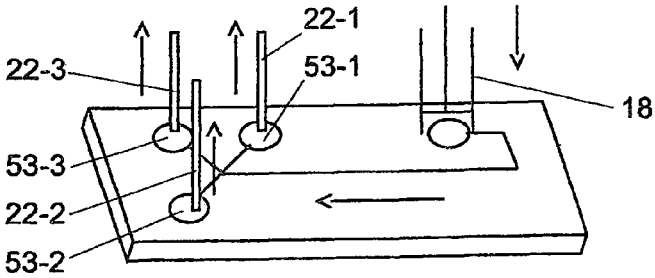
Figure 11K:
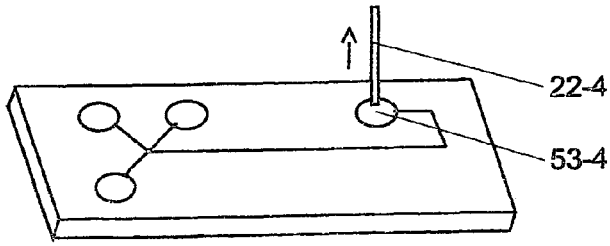
Figure 11L:
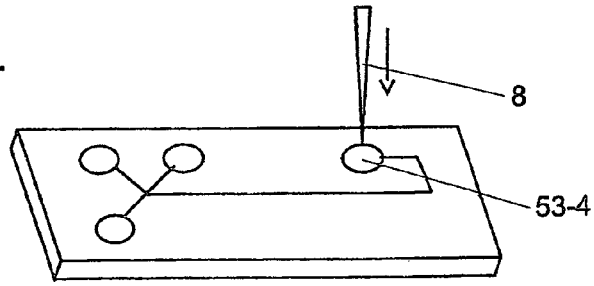
Figure 11M:
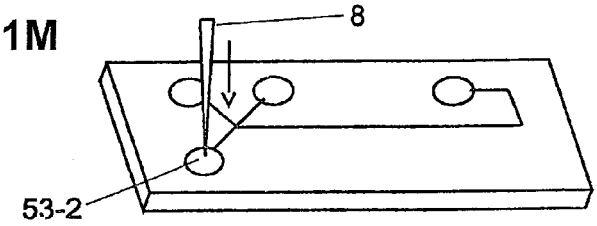
Figure 11N:
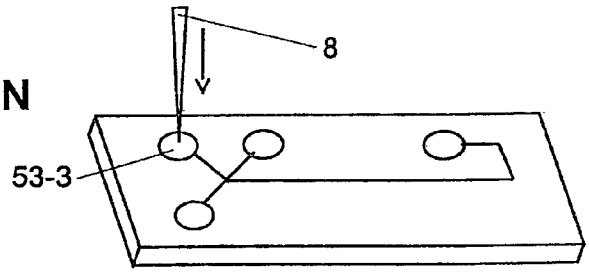
Figure 11O:
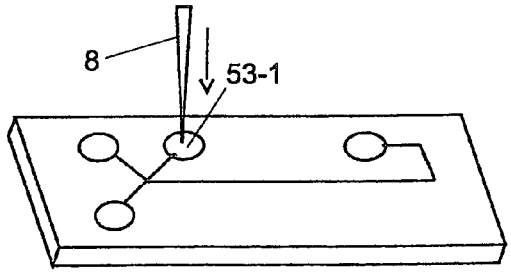
Figure 11P:
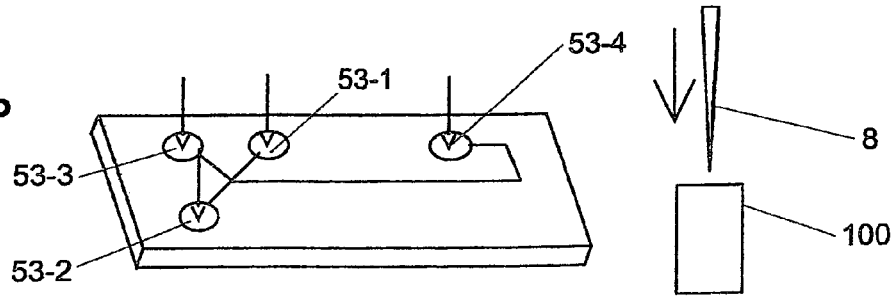
Figure 11Q:
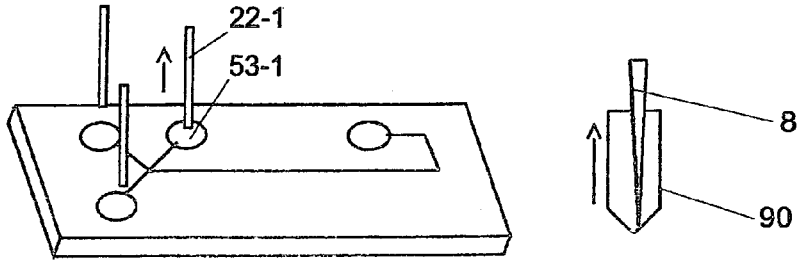
Figure 11R:
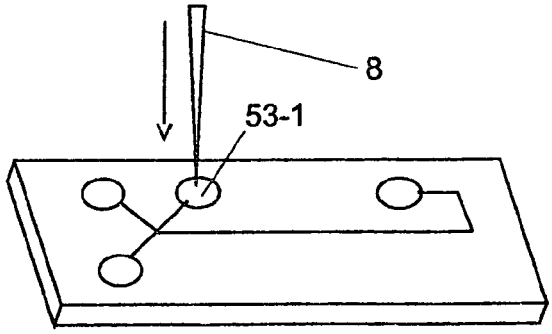
Figure 11S:
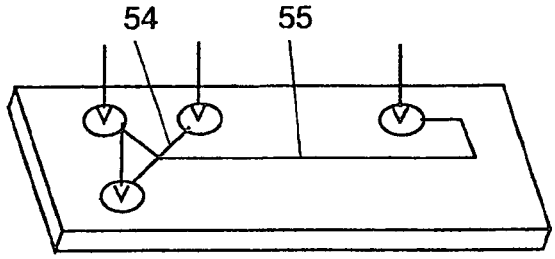
Figure 11T:
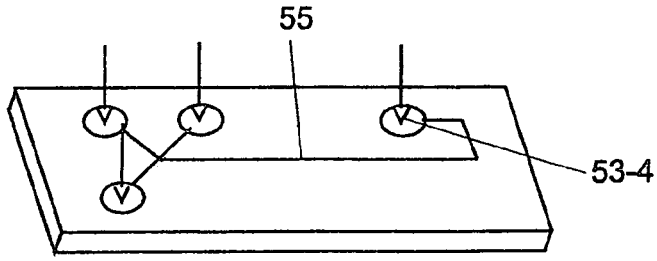
Figure 11U:
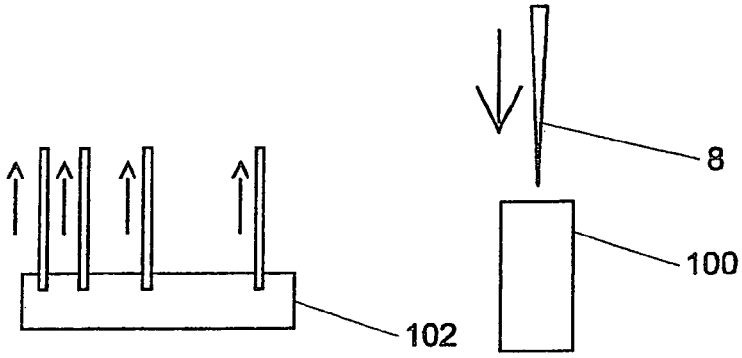
Figure 12:
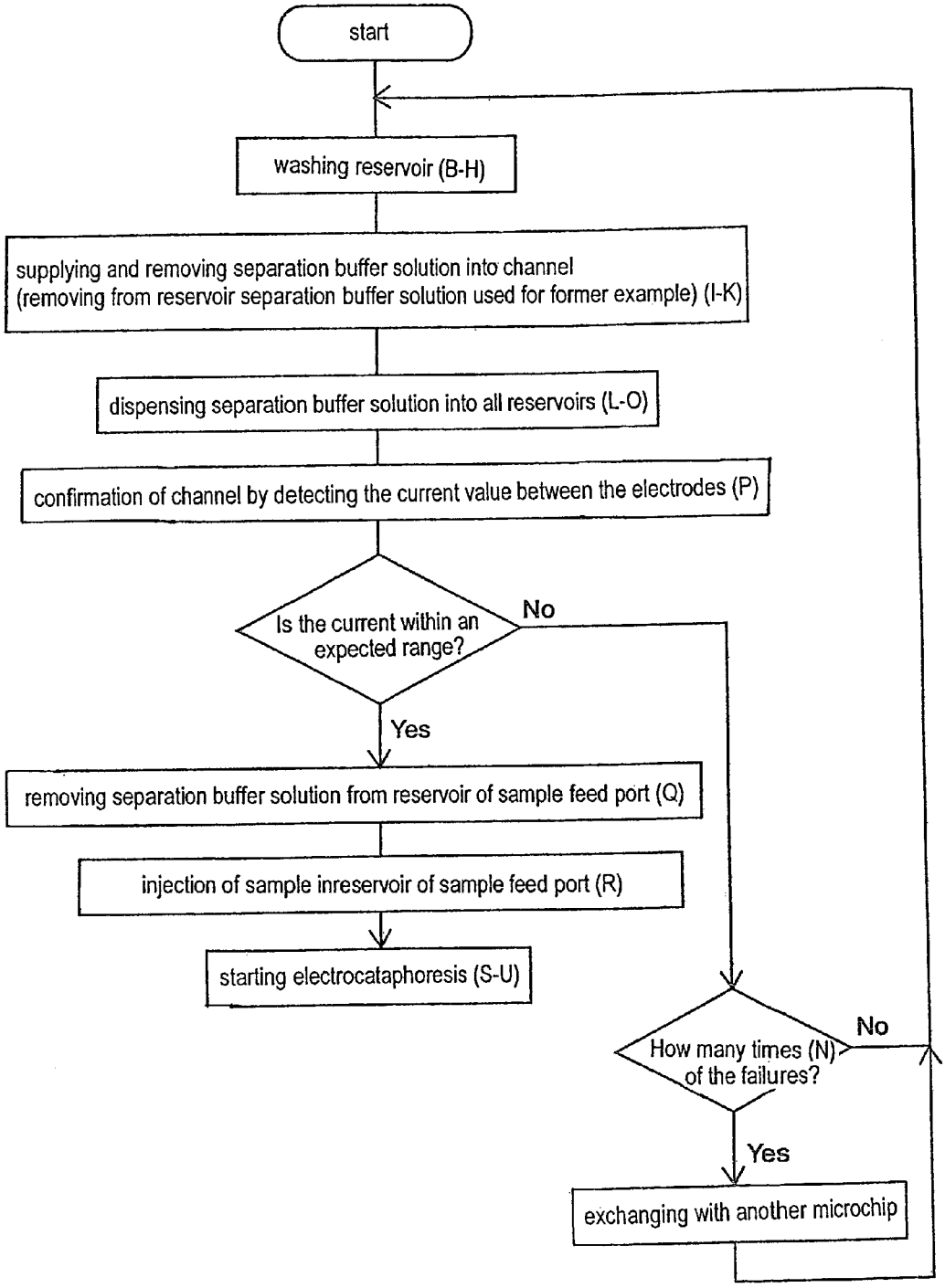
FIG. 12 is a flow chart showing the processing procedure according to the apparatus of FIG. 1.

The processing procedure in the case when the microchip is repeatedly used in this microchip processing apparatus is shown in FIGS. 11A-11U, and it is explained using the flow chart in FIG. 12. The symbols (A-U) in the flow chart in FIG. 12 stand for the processes in FIG. 11A-11U. The processing performed here is a series of processes in which a microchip used in the previous round of analysis is sequentially washed; a separation buffer solution is filled into the channel; a phoresis test is performed as to whether or not the current flows normally in the channel in a state when separation buffer solution is filled into all reservoirs; a sample is dispensed and phoresis is started; and the dispending probe and the suction nozzle are washed.

FIG. 11A illustrates the microchip 5 as the one shown in FIGS. 3A-3C and 4. It has a separation channel 55 and the sample introduction channel 54 is provided in an intersecting manner, having reservoirs 53 formed on the ends of each channel 54 and 55. The $1^{st}$ to the $4^{th}$ reservoirs, shown in FIG. 4, are indicated here with the symbols 53-1 to 53-4.

FIG. 11B is the state when analysis of the previous sample was finished, and separation buffer solution is remaining in the channel and each reservoir, and separated sample also is remaining in that separation buffer solution.

FIG. 11C illustrates a state wherein in order to wash the sample injection reservoir 53-1, only the suction nozzle 22-1 is inserted into the reservoir 53-1. The suction nozzle 22-2 and the suction nozzle 22-3 also move vertically simultaneously with the suction nozzle 22-1, but because the length of the suction nozzle 22-1 is longer than that of the other suction nozzles 22-2 and 22-3, only the suction nozzle 22-1 is inserted into the reservoir 53-1 and enters a state of being pushed against the bottom part of that reservoir 53-1. However, the other suction nozzles 22-2 and 22-3, being shorter, are not inserted into the corresponding reservoirs 53-2 and 53-3. In this state the separation buffer solution inside the reservoir 53-1 is drawn and removed by being drawn using the suction nozzle 22-1.

FIG. 11D illustrates wherein wash liquid is supplied into the reservoir 53-1 from the dispensing probe 8.

FIG. 11E illustrates wherein again, the suction nozzle 22-1 is inserted into the reservoir 53-1, and the wash liquid is drawn and discharged.

FIG. 11F illustrates wherein wash liquid is again supplied into the reservoir 53-1 from the dispensing probe 8.

FIG. 11G illustrates wherein the suction nozzles 22-1~22-3 are inserted respectively into the reservoirs 53-1~53-3. At this time, the three suction nozzles 22-1~22-3 are inserted into the respective reservoirs 53-1~53-3, and they contact with the bottoms of the respective reservoirs by being pushed against them. The liquid is drawn simultaneously by those three suction nozzles 22-1~22-3 and is removed. The dispensing probe 8 is inserted into a rinse port 100 and the entirety of the wash liquid inside the dispensing probe 8 is ejected, and also the inside and outside of the dispensing probe 8 are washed.

FIG. 11H illustrates wherein the fourth suction nozzle 22-4 is inserted into the other one reservoir 53-4. This suction nozzle 22-4 is provided separately from the three suction nozzles 22-1~22-3, and it is placed near a cylinder for air supply port shown in FIG. 15 explained later. The suction nozzle 22-4 also contacts the bottom of the reservoir 53-4 by being pushed against it. The separation buffer solution inside the reservoir 53-4 is drawn by the suction nozzle 22-4 and is removed. The dispensing probe 8 draws the separation buffer solution from the reagent container 91 containing buffer solution.

FIG. 11I illustrates step I, wherein the dispensing probe 8 is moved to the reservoir 53-4, and it dispenses the separation buffer solution.

FIG. 11J illustrates wherein the air supply port 18 is pushed onto the reservoir 53-4 to maintain air-tightness, and air is supplied into the channel from the reservoir 53-4 by driving of the cylinder shown in FIG. 13 and discussed below. The suction nozzles 22-1~22-3 are inserted respectively into the other reservoirs 53-1~53-3, and the separation buffer solution overflowing into the respective reservoirs 53-1~53-3 from the channel is drawn and removed.

FIG. 11K illustrates wherein the suction nozzle 22-4 is inserted into the reservoir 53-4, and the separation buffer solution in that reservoir 53-4 is drawn and removed, defining a state in which the separation buffer solution remains only in the channel.

FIGS. 11L-11O illustrate wherein the separation buffer solution is dispensed sequentially into the reservoirs 53-1~53-4 by the dispensing probe 8.

FIG. 11P illustrates wherein electrodes are inserted into the respective reservoirs, and a phoresis test is performed. Here, it is confirmed as to whether or not dirt or bubbles are mixed in the channel by detecting the current value between the electrodes. The voltage applied to the channel here may be the same as the phoresis voltage for separating samples, but it also may be voltage lower than that.

The dispensing probe 8 having dispensed the separation buffer solution is inserted into the rinse port 100, and the separation buffer solution inside the dispensing probe 8 is entirely ejected and also the inside and outside of the dispensing probe 8 are washed.

When it was determined that filling of separation buffer into the channel was performed normally in this phoresis test process, the flow advances to the next process (FIG. 11Q) for injecting the sample and performing analysis, but when it was not determined that filling of separation buffer into the channel was performed normally, the flow returns to the process B for refilling of separation buffer solution into the channel.

The number of times that refilling of separation buffer solution into the channel is allowed (step N) is set in advance, and when it is not determined that filling of separation buffer solution into the channel was performed normally even when refilling of separation buffer solution was performed that number of times, the flow returns to the process B after exchanging with another microchip. The number of times (N) that the refilling of separation buffer solution is allowed is non-limiting, and may be set, for example, to 2 or 3.

FIG. 11Q illustrates step Q, wherein the suction nozzle 22-1 is inserted only in the sample supply reservoir 53-1, and the separation buffer solution in that reservoir 53-1 is drawn and removed.

FIG. 11R illustrates step R, wherein a sample is injected into that reservoir 53-1 from the dispensing probe 8.

FIG. 11S illustrates step S, wherein electrodes are inserted into the respective reservoirs 53-1~53-3 and voltage for sample introduction is applied, and the sample is led to the position of intersection of the channels 54 and 55.

FIG. 11T illustrates a step T, wherein the applied voltage is switched to voltage for phoresis separation, and the sample is electrophoretically separated toward the reservoir 53-4 in the separation channel 55.

FIG. 11U illustrates a step U, wherein after the end of separation, each suction nozzle 22-1~22-4 is inserted into a rinse port 102 where the wash liquid is drawn and the insides and outsides of the nozzles are washed. In addition, the probe 8 is inserted into the rinse port 100 and the inside and outside are washed.

Next, an embodiment of a separation buffer solution filling device is explained according to FIGS. 13A-13C and FIG. 14.

Figure 14:
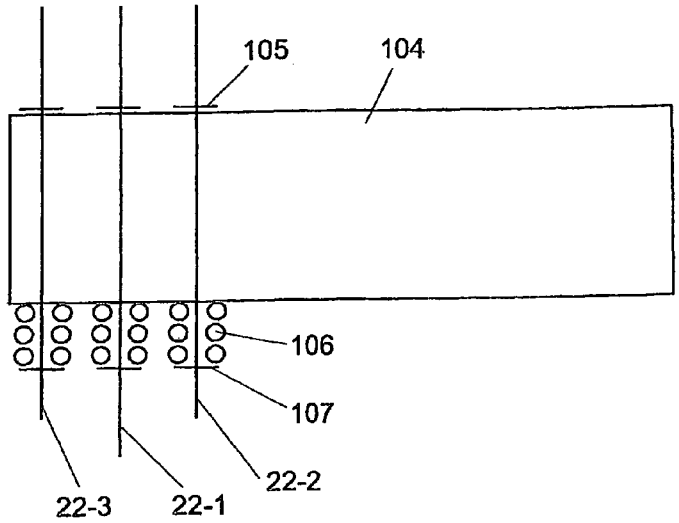
FIG. 14 is an enlarged sectional view of the suction nozzle part of the separation buffer solution filling device, according to the apparatus of FIG. 1.

The three suction nozzles 22-1~22-3 are supported to be capable of sliding on a nozzle holding member 104, and as shown in greater detail in FIG. 14, the range of movement in the vertical direction is restricted by upper and lower stoppers 105 and 107, and they are forced downward from the nozzle holding member 104 by a spring 106. These suction nozzles 22-1~22-3 can be moved upward in opposition to the spring 106 by being pushed against the reservoirs.

Figures 13A, 13B, 13C:
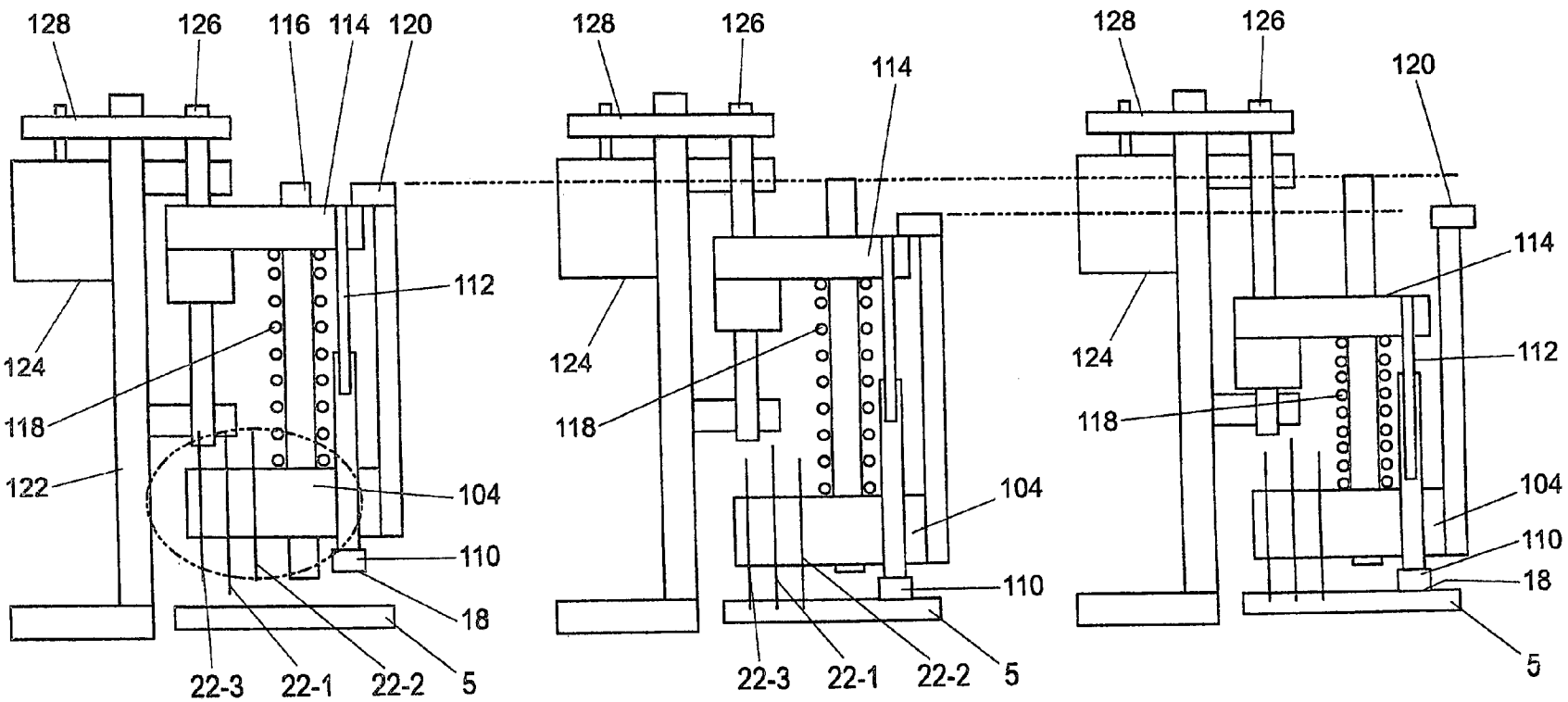
FIG. 13A is a front view of the separation buffer solution filling device in a waiting position according to the apparatus of FIG. 1.
FIG. 13B is another front view of the separation buffer solution filling device in a state where the air supply port and the suction nozzle are pushed against the microchip.
FIG. 13C is another front view wherein the separation, buffer solution is pressed into the channel.

As shown in FIG. 13A, in the state before the suction nozzles are inserted into the reservoirs, the length that the suction nozzle 22-1 projects downward from the nozzle holding member 104 is set longer than the amount of depth of the liquid present in the reservoir compared with the other suction nozzles 22-2 and 22-3. This means that at the point when the tip of the suction nozzle 22-1 contacts the bottom of the reservoir 53-1 in the state projecting downward, the suction nozzles 22-2 and 22-3 do not yet reach the liquid surfaces inside the reservoirs 53-2 and 53-3. When the needle holding member 104 is moved further downward, all of the suction nozzles 22-1~22-3 contact with the bottoms of the reservoirs.

In this embodiment, the nozzle holding member 104 doubles as an air cylinder holding member, and a cylinder 108 is fixed to the nozzle holding member 104. A seal part 110 is provided on an open part on the front end of the cylinder 108, and the opening having that seal part serves as the air supply port 18. The cylinder 108 has a plunger 112 on its upper side, and air is ejected from the cylinder by vertical movement of the plunger 112. The plunger 112 is fixed to a plunger holding member 114.

The nozzle holding member (air cylinder holding member) 104 and the plunger holding member 114 are supported to be capable of sliding on a linear guide 116, and a coil spring 118 is inserted between the nozzle holding member 104 and the plunger holding member 114. A stopper 120 which extends upward from the nozzle holding member 104 is provided, and the stopper 120 forms the top dead center of the plunger holding member 114.

This separation buffer solution filling device is fixed to a support body 122, and the support body 122 is attached to a horizontal directional movement mechanism, whereby this separation buffer solution filling device becomes capable of movement in the horizontal direction. As a mechanism for moving the nozzle holding member 104 and the plunger holding member 114 in the vertical direction, a stepping motor is attached as a drive motor 124 to the support body 122, and a ball screw 126 is fitted on the plunger holding member 114. A timing belt 128 is hung between the motor 124 and the ball screw 126, and the rotation of the motor 124 is transmitted to the ball screw 126 by means of the timing belt 128. The plunger holding member 114 is moved in the vertical direction by the rotation of the ball screw 126. In this embodiment, because the nozzle holding member 104 doubles as an air cylinder holding member, the mechanisms for driving of the suction nozzles 22-1~22-3 and moving and driving of the air cylinder 108 can be driven by one drive motor 124.

FIGS. 13A-13C illustrate another embodiment of the present invention in which the nozzle holding member 104 does not have suction nozzles 22-1~22-3, that is, a mode in which the member 104 functions simply as an air cylinder holding member without performing the function of a nozzle holding member.

Next, the operation of filling separation buffer solution into the microchip 5 is explained according to FIGS. 13A-13C. This operation corresponds to the processes after the separation buffer solution was supplied to the reservoir 53-4 in FIG. 11I, and up to when the separation buffer solution is pressed in by supply of air from the air supply port 18 in FIG. 11J, and also the separation buffer solution overflowing from the channel is drawn by the suction nozzles 22-1~22-3 and discharged.

FIG. 13A illustrates the waiting state wherein the plunger holding member 114 is at the top dead center. In this state the separation buffer solution has already been supplied to the reservoir 53-4 of the microchip.

In FIG. 13B the ball screw 126 rotates, the plunger holding member 114 goes down, and the nozzle holding member 104 is pushed down by means of the coil spring 118. As shown in FIG. 13B, the seal part 110 of the cylinder 108 is contacted onto the reservoir 53-4 maintaining air-tightness, and simultaneously the three suction nozzles 22-1~22-3 become in a state being pushed against the bottoms of the respective reservoirs 53-1~53-3.

As shown in FIG. 13C, when the plunger holding member 114 is caused to descend by further rotation of the ball screw 126, further descent of the nozzle holding member 104 is restricted by the lower end of the cylinder 108 contacting with the microchip 5. However, as shown in FIG. 13C, the plunger holding member 114 separates from the stopper 120 by contraction of the coil spring 118 and descends further, and it pushes the plunger 112 to supply air from the air supply port 18. By this, the separation buffer solution inside the reservoir 53-4 is pressed into the channel, and the separation buffer solution overflowing from the channel into the reservoirs 53-1~53-3 is drawn by the respective suction nozzles 22-1~22-3 and is removed.

After the separation buffer solution is pressed into the channel in the state shown in FIG. 13C, the ball screw 126 rotates in the reverse direction, and it returns to the state in FIG. 13B. After that, when the ball screw 126 further rotates in the reverse direction, the plunger holding member 114 hits the stopper 120 whereby the nozzle holding member 104 is pulled up, and it returns to the waiting state in FIG. 13A.

In the separation buffer solution filling device in FIGS. 13A-13C, when the rotation of the ball screw 126 stops at the point where the tip of the suction nozzle 22-1 has contacted with the bottom surface of the reservoir 53-1, only the suction nozzle 22-1 is inserted into the reservoir 53-1. The other suction nozzles 22-2 and 22-3 come to stop at a position not reaching the liquid surfaces of the respective reservoirs 53-2 and 53-3. This state is illustrated in FIG. 11E and FIG. 11Q.

Although it is not illustrated in FIGS. 13A-13C, another one suction nozzle 22-4 is provided near the cylinder 108, and it is forced downward by a spring just as the other suction nozzles 22-1~22-3. Because the support body 122 is moving in the horizontal direction when that suction nozzle 22-4 is inserted into the reservoir 53-4, the other suction nozzles 22-1~22-3 are not inserted into the respectively corresponding reservoirs 53-1~53-3.

Figure 15A:
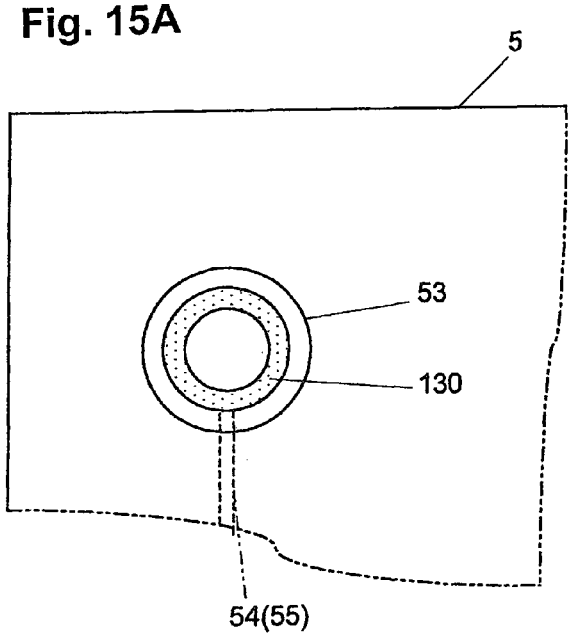
FIG. 15A is a plan view of an embodiment wherein a liquid is drawn from the reservoir by the suction nozzle, according to the apparatus of FIG. 1.
Figure 15B:
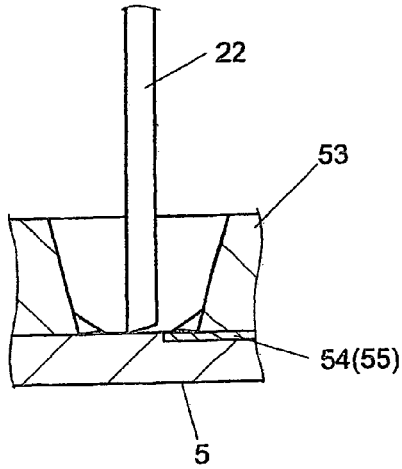
FIG. 15B is a section view of an embodiment wherein a liquid is drawn from the reservoir by the suction nozzle, according to the apparatus of FIG. 1.

FIGS. 15A and 15B show the state of drawing and removal of the liquid inside the reservoir in the case that the suction nozzle 22 (22-1~22-4) contacted a place other than the peripheral part of the bottom surface of the reservoir 53 (53-1~53-3), for example the center part.

The outer diameter of the tip of the suction nozzle 22 is smaller than the size of the bottom part of the reservoir 53. The tip of the suction nozzle 22 is cut diagonally, and it draws liquid from a gap between the bottom surface of the reservoir and the tip of the nozzle. When the suction nozzle 22 contacts a place other than the side wall part of the bottom part of the reservoir, for example, the center part, the liquid 130 remains in a donut shape at the peripheral part of the bottom part of the reservoir. If it is not cleaned sufficiently, it will become a cause of carry-over to the next analysis, particularly in the case where the reservoir 53 comprises sample supply.

Therefore, in the case when liquid remains at the peripheral part of the bottom part of the reservoir, the quantity of liquid for washing the reservoir must be made greater or the number of times washing is performed must be increased. Accordingly, the washing time becomes longer, and as a result the overall analysis time becomes longer.

Figure 16:
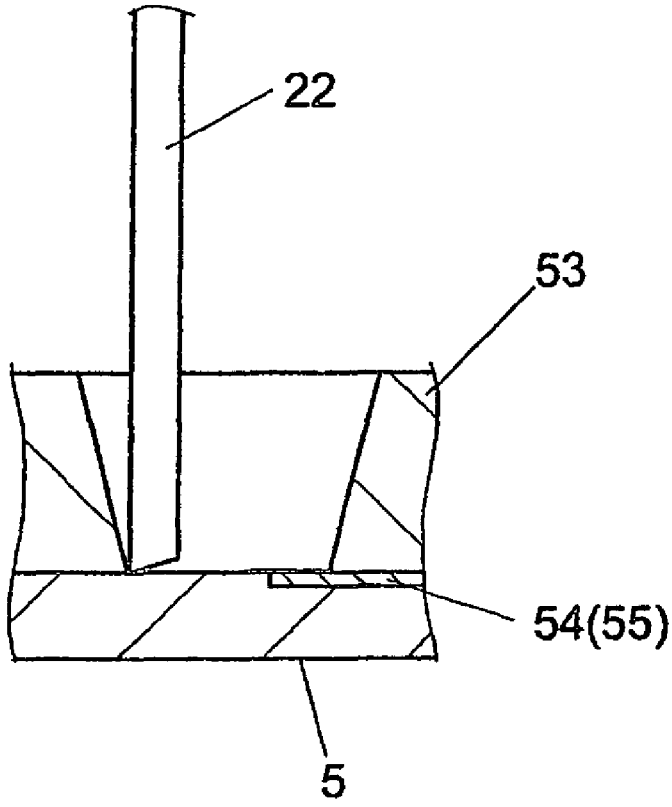
FIG. 16 is a sectional view illustrating a state wherein liquid is drawn from the reservoir by the suction nozzle of an embodiment wherein a liquid is drawn from the reservoir by the suction nozzle, according to the apparatus of FIG. 1.

FIG. 16 illustrate an exemplary embodiment that resolves this problem. Suction nozzle 22 is inserted so as to push against the perimeter wall part of the bottom part of the reservoir 53. By adjusting the position of the suction nozzle 22 in this manner, it is possible to draw and remove without leaving any liquid in the reservoir 53. As a result, the carry-over becomes smaller, and it becomes sufficient with less wash liquid, and the washing time becomes shorter, and as a result the analysis time can be shortened. Also, if under the same washing conditions, the analytical precision is improved by the fact that the carry-over becomes smaller.

The disclosure of Japanese Patent Application No. 2005-296538 filed on Oct. 11, 2005 is incorporated as a reference.

While the invention has been explained with reference to the specific embodiments of the invention, the explanation is illustrative and the invention is limited only by the appended claims.

What is claimed is:

1. A microchip processing apparatus for processing a microchip with at least one main separation channel, said microchip processing apparatus comprising:

a microchip holding part for holding the microchip;

a container containing a sample or a reagent;

a hollow dispensing probe having a needle integrally formed on a tip of the dispensing probe, the needle of the dispensing probe being configured to be inserted into the container from above the container, to draw the sample or reagent, and to inject the sample or reagent to a prescribed position on the held microchip; and a dispensing probe driving mechanism configured to move the dispensing probe between prescribed positions of the microchip and the container;

wherein the dispensing probe driving mechanism includes a dispensing probe holder for holding the dispensing probe and moving in a vertical direction; a drive system for driving the dispensing probe and the dispensing probe holder in the vertical direction; a restraining mechanism slidably attached to the dispensing probe holder and having a restraining member which is arranged to contact an upper surface of the container; and a forcing unit disposed between the restraining mechanism and the dispensing probe holder for urging the restraining mechanism downward relative to the dispending probe holder, and wherein when the dispensing probe holder is moved down, the dispensing probe and the restraining mechanism move down toward the container; after the restraining member contacts the container, when the dispensing probe holder is moved further down, the dispensing probe enters the container while the dispensing probe holder does not move and the forcing unit is pulled; and when the dispensing probe holder is moved up, the dispensing probe is removed from the container while the restraining member holds the upper surface of the container by a pulled force of the forcing unit.

2. The microchip processing apparatus according to claim 1, wherein the container includes an upper opening closed by a seal material capable of being penetrated by the needle and is held in a state that an upper opening is opened, and the needle is configured to penetrate the seal material.

3. The microchip processing apparatus according to claim 2, wherein the dispensing probe is slidably held at the probe holder, and includes another forcing unit for forcing the dispensing probe downward against the probe holder, and a position sensor configured to indicate that the dispensing probe is displaced upward by a prescribed amount against the probe holder.

4. The microchip processing apparatus according to claim 3, wherein the another forcing unit has a forcing strength set such that the dispensing probe is not displaced to an operating position of the position sensor when the needle penetrates the seal material of the container, and the dispensing probe is displaced to the operating position of the position sensor when the needle collides with an object harder than the seal material of the container.

5. The microchip processing apparatus according to claim 3, wherein the dispensing probe driving mechanism is configured to stop dispensing upon a signal from the position sensor during reagent dispensing.

6. The microchip processing apparatus according to claim 1, wherein the dispensing probe comprises a side surface, and a groove disposed on the side surface and having the tip inserted into the container such that an inside of the container and a surrounding atmosphere communicate when the sample is drawn.

7. The microchip processing apparatus according to claim 1, further comprising a liquid surface sensor disposed on the tip of the dispensing probe.

8. The microchip processing apparatus according to claim 7, wherein the liquid surface sensor is an electrostatic capacitance sensor.

9. The microchip processing apparatus according to claim 7, further comprising a remaining liquid quantity display device configured to calculate and display a remaining liquid quantity inside the container based on an output of the liquid surface sensor.

10. The microchip processing apparatus according to claim 7, further comprising a warning unit for calculating a remaining liquid quantity inside the container based on an output of the liquid surface sensor, and for providing a notification of an insufficient quantity of remaining liquid, prior to a start of an analysis.

11. The microchip processing apparatus according to claim 7, further comprising a warning unit for calculating a remaining liquid quantity inside the container based on an output of the liquid surface sensor, and for providing a notification of an insufficient quantity of remaining liquid.

12. The microchip processing apparatus according to claim 1, wherein:

the microchip holding part is configured to hold the microchip which has a plurality of main channels;

a control part configured to control a preprocessing process and an analysis process in the main channels is provided;

the dispensing probe is used by the plurality of main channels, and performs the preprocessing process in advance of an analysis process performed in the main channels; and the control part is further configured such that the preprocessing process is performed independently for each main channel in a manner such that the control part moves to the preprocessing process of the next main channel when the preprocessing process in one main channel is finished, and the analysis process is performed in parallel in the main channel in which the preprocessing process was finished.

13. The microchip processing apparatus according to claim 1, wherein the dispensing probe driving mechanism further includes a stopper attached to the restraining mechanism for restricting a lower end of the restraining member from moving further downward from a lower end of the dispensing probe.

* * * * *